US007006966B2

(12) United States Patent
Yamaura et al.

(10) Patent No.: US 7,006,966 B2
(45) Date of Patent: Feb. 28, 2006

(54) SPEECH ENCODING APPARATUS, SPEECH ENCODING METHOD, SPEECH DECODING APPARATUS, AND SPEECH DECODING METHOD

(75) Inventors: Tadashi Yamaura, Tokyo (JP); Hirohisa Tasaki, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 689 days.

(21) Appl. No.: 10/083,556

(22) Filed: Feb. 27, 2002

(65) Prior Publication Data

US 2002/0128829 A1 Sep. 12, 2002

(30) Foreign Application Priority Data

Mar. 9, 2001 (JP) ..... 2001-067631

(51) Int. Cl.
*G10L 19/12* (2006.01)

(52) U.S. Cl. ..... 704/223; 704/219; 704/221

(58) Field of Classification Search ..... 704/219–223, 704/207, 501
See application file for complete search history.

(56) References Cited

U.S. PATENT DOCUMENTS 6,052,660 A * 4/2000 Sano ..... 704/221
6,556,966 B1 * 4/2003 Gao ..... 704/220

FOREIGN PATENT DOCUMENTS

EP 0714089 A2 5/1996
EP 1024477 A1 8/2000
EP 1052620 A1 11/2000
JP 8-44397 2/1996

OTHER PUBLICATIONS

Improved Excitation for Phonetically-Segmented VXC Speech Coding Below 4Kb/s, IEEE Global Telecommunications Conference & Exhibition, Dec. 2-5, 1990, pp. 946-950, Conference Record vol. 2 of 3 "Communications: Connecting the Future".
3rd Generation Partnership Project; Technical Specification Group Services and System Aspects; Mandatory Speech Codec speech processing functions AMR speech codec; Transcoding functions 3G TS 26.090 version 3.1.0 Dec. 1999, pp. 37-40, no day.

* cited by examiner

*Primary Examiner*—W. R. Young
*Assistant Examiner*—Huyen X. Vo
(74) *Attorney, Agent, or Firm*—Birch, Stewart, Kolasch & Birch, LLP

(57) ABSTRACT

The present invention comprises: first periodicity providing means for emphasizing periodicity of a fixed code vector output from at least one fixed excitation code book by use of a first periodicity emphasis coefficient adaptively determined based on a predetermined rule; and second periodicity providing means for emphasizing periodicity of a fixed code vector output from at least one fixed excitation code book by use of a predetermined second periodicity emphasis coefficient.

18 Claims, 18 Drawing Sheets

SIGNAL TO BE ENCODED
T T T
FIXED CODE VECTOR MADE PERIODIC
T T T
IMPULSE RESPONSE
AMPLITUDE
0 T 2T 3T t
COMB FILTER
FIRST FIXED EXCITATION CODE BOOK
IMPULSE RESPONSE
AMPLITUDE
0 T 2T 3T t
COMB FILTER
FIXED CODE VECTOR MADE PERIODIC
T T T
SECOND FIXED EXCITATION CODE BOOK

SPEECH ENCODING APPARATUS, SPEECH ENCODING METHOD, SPEECH DECODING APPARATUS, AND SPEECH DECODING METHOD

BACKGROUND OF THE INVENTION

1. Field of the Invention

The present invention relates to a speech encoding apparatus and a speech encoding method for compressing a digital speech signal to reduce its information quantity. The present invention also relates to a speech decoding apparatus and a speech decoding method for decoding speech code generated by the above speech encoding apparatus so as to generate a digital speech signal.

2. Description of Related Art

Many of prior art speech encoding methods and speech decoding methods divide an input speech into spectral envelope information and excitation information, and encode each type of information in units of frames each having a predetermined length to generate speech code. The generated speech code is decoded into the spectral envelope information and the excitation information which are then combined by use of a synthesis filter to obtain a decoded speech. The most representative of speech encoding/decoding apparatuses to which the above speech encoding/decoding methods are applied include those using the Code-Excited Linear Prediction (CELP) system.

FIG. 13 is a schematic diagram showing the configuration of a conventional CELP-type speech encoding apparatus. In the figure, reference numeral 1 denotes a linear prediction analysis unit for analyzing an input speech and extracting linear prediction coefficients, which denote spectral envelope information of the input speech, while reference numeral 2 denotes a linear prediction coefficient encoding unit for encoding the linear prediction coefficients extracted by the linear prediction analysis unit 1 and outputting the resultant code to a multiplexing unit 6 as well as outputting quantized values of the linear prediction coefficients to an adaptive excitation encoding unit 3, a fixed excitation encoding unit 4, and a gain encoding unit 5.

Reference numeral 3 denotes the adaptive excitation encoding unit for generating a tentative synthesized speech by use of the quantized values of the linear prediction coefficients output from the linear prediction coefficient encoding unit 2 as well as selecting adaptive excitation code with which the distance between the tentative synthesized speech and the input speech is minimized and outputting the thus selected adaptive excitation code to the multiplexing unit 6. The adaptive excitation encoding unit 3 also outputs to the gain encoding unit 5 an adaptive excitation signal (a time-series vector obtained as a result of repeating a past excitation signal having a given length) corresponding to the adaptive excitation code. Reference numeral 4 denotes the fixed excitation encoding unit for generating a tentative synthesized speech by use of the quantized values of the linear prediction coefficients output from the linear prediction coefficient encoding unit 2 as well as selecting fixed excitation code with which the distance between the tentative synthesized speech and a signal to be encoded (a signal obtained as a result of subtracting from the input speech the synthesized speech produced based on the adaptive excitation signal) is minimized and outputting the selected fixed excitation code to the multiplexing unit 6. The fixed excitation encoding unit 4 also outputs to the gain encoding unit 5 a fixed excitation signal which is a time-series vector corresponding to the fixed excitation code.

Reference numeral 5 denotes the gain encoding unit for multiplying both the adaptive excitation signal output from the adaptive excitation encoding unit 3 and the fixed excitation signal output from the fixed excitation encoding unit 4 by each element of a gain vector, and adding each respective pair of the multiplication results, so as to generate an excitation signal. The gain encoding unit 5 also generates a tentative synthesized speech from the above excitation signal by use of the quantized values of the linear prediction coefficients output from the linear prediction coefficient encoding unit 2, selects gain code with which the distance between the tentative synthesized speech and the input speech is minimized, and outputs the selected gain code to the multiplexing unit 6. Reference numeral 6 denotes the multiplexing unit for multiplexing the code of the linear prediction coefficients encoded by the linear prediction coefficient encoding unit 2, the adaptive excitation code output from the adaptive excitation encoding unit 3, the fixed excitation code output from the fixed excitation encoding unit 4, and the gain code output from the gain encoding unit 5 so as to produce speech code.

FIG. 14 is a schematic diagram showing the internal configuration of the fixed excitation encoding unit 4. In the figure, reference numeral 11 denotes a fixed excitation code book; 12 a synthesis filter; 13 a distortion calculating unit; and 14 a distortion evaluating unit.

FIG. 15 is a schematic diagram showing the configuration of a conventional CELP-type speech decoding apparatus. In the figure, reference numeral 21 denotes a separating unit for separating the speech code output from the speech encoding apparatus into the code of the linear prediction coefficients, the adaptive excitation code, the fixed excitation code, and the gain code, which are then supplied to a linear prediction coefficient decoding unit 22, an adaptive excitation decoding unit 23, a fixed excitation decoding unit 24, and a gain decoding unit 25, respectively. Reference numeral 22 denotes the linear prediction coefficient decoding unit for decoding the code of the linear prediction coefficients output from the separating unit 21 and outputting the decoded quantized values of the linear prediction coefficients to a synthesis filter 29.

Reference numeral 23 denotes the adaptive excitation decoding unit for outputting an adaptive excitation signal (a time-series vector obtained as a result of repeating a past excitation signal) corresponding to the adaptive excitation code output from the separating unit 21, while reference numeral 24 denotes the fixed excitation decoding unit for outputting a fixed excitation signal (a time-series vector) corresponding to the fixed excitation code output from the separating unit 21. Reference numeral 25 denotes the gain decoding unit for outputting a gain vector corresponding to the gain code output from the separating unit 21.

Reference numeral 26 denotes a multiplier for multiplying the adaptive excitation signal output from the adaptive excitation decoding unit 23 by an element of the gain vector output from the gain decoding unit 25, while reference numeral 27 denotes another multiplier for multiplying the fixed excitation signal output from the fixed excitation decoding unit 24 by another element of the gain vector output from the gain decoding unit 25. Reference numeral 28 denotes an adder for adding the multiplication result of the multiplier 26 and the multiplication result of the multiplier 27 together to generate an excitation signal. Reference numeral 29 denotes the synthesis filter for performing synthesis filtering processing on the excitation signal generated by the adder 28 so as to produce an output speech.

FIG. 16 is a schematic diagram showing the internal configuration of the fixed excitation decoding unit 24. In the figure, reference numeral 31 denotes a fixed excitation code book.

The operations of the speech encoding apparatus and the speech decoding apparatus will be described below.

The conventional speech encoding/decoding apparatuses perform processing in units of frames each having a time duration of approximately 5 to 50 ms.

Upon receiving a speech, the linear prediction analysis unit 1 in the speech encoding apparatus analyzes the input speech and extracts the linear prediction coefficients, which are spectral envelope information on the speech.

After the linear prediction analysis unit 1 has extracted the linear prediction coefficients, the linear prediction coefficient encoding unit 2 encodes the linear prediction coefficients and outputs the code to the multiplexing unit 6. The linear prediction coefficient encoding unit 2 also outputs quantized values of the linear prediction coefficients to the adaptive excitation encoding unit 3, the fixed excitation encoding unit 4, and the gain encoding unit 5.

The adaptive excitation encoding unit 3 has a built-in adaptive excitation code book storing past excitation signals having a predetermined length, and generates a time-series vector which is obtained as a result of periodically repeating a past excitation signal, based on each internally-generated adaptive excitation code (indicated by a binary number having a few bits).

The adaptive excitation encoding unit 3 then multiplies each time-series vector by each appropriate gain value, and generates a tentative synthesized speech by passing the time-series vector through the synthesis filter which uses the quantized values of the linear prediction coefficients output from the linear prediction coefficient encoding unit 2.

Furthermore, the adaptive excitation encoding unit 3 evaluates, for example, the distance between the tentative synthesized speech and the input speech to obtain the encoding distortion, and selects and outputs to the multiplexing unit 6 adaptive excitation code with which the distance is minimized as well as outputting to the gain encoding unit 5 a time-series vector corresponding to the selected adaptive excitation code as an adaptive excitation signal.

The adaptive excitation encoding unit 3 also outputs to the fixed excitation encoding unit 4 a signal obtained as a result of subtracting from the input speech a synthesized speech produced based on the adaptive excitation signal, as a signal to be encoded.

Next, the operation of the fixed excitation encoding unit 4 will be described.

The fixed excitation code book 11 included in the fixed excitation encoding unit 4 stores fixed code vectors which are noise-like time-series vectors, and sequentially outputs a time-series vector according to each fixed excitation code (indicated by a binary number having a few bits) output from the distortion evaluating unit 14. Each time-series vector is then multiplied by each appropriate gain value and input to the synthesis filter 12.

The synthesis filter 12 uses the quantized values of the linear prediction coefficients output from the linear prediction coefficient encoding unit 2 to generate a tentative synthesized speech for each gain-multiplied time-series vector.

The distortion calculating unit 13 calculates, for example, the distance between the tentative synthesized speech and the signal to be encoded output from the adaptive excitation encoding unit 3 to obtain the encoding distortion.

The distortion evaluating unit 14 selects and outputs to the multiplexing unit 6 fixed excitation code with which the distance between the tentative synthesized speech and the signal to be encoded calculated by the distortion calculating unit 13 is minimized as well as directing the fixed excitation code book 11 to output to the gain encoding unit 5 a time-series vector corresponding to the selected fixed excitation code as a fixed excitation signal.

The gain encoding unit 5 has a built-in gain code book storing gain vectors, and sequentially reads a gain vector from the gain code book according to each internally-generated gain code (indicated by a binary number having a few bits).

The gain encoding unit 5 multiplies both the adaptive excitation signal output from the adaptive excitation encoding unit 3 and the fixed excitation signal output from the fixed excitation encoding unit 4 by each element of the gain vector, and adds each respective pair of the multiplication results together to generate an excitation signal.

The gain encoding unit 5 then generates a tentative synthesized speech by passing the excitation signal through a synthesis filer which uses the quantized values of the linear prediction coefficients output from the linear prediction coefficient encoding unit 2.

Furthermore, the gain encoding unit 5 evaluates the distance between the tentative synthesized speech and the input speech to obtain the encoding distortion, selects and outputs to the multiplexing unit 6 gain code with which the distance is minimized, and outputs to the adaptive excitation encoding unit 3 an excitation signal corresponding to the gain code. The adaptive excitation encoding unit 3 then uses the excitation signal, which was selected by the gain encoding unit 5 and corresponds to the gain code, to update its built-in adaptive excitation code book.

The multiplexing unit 6 multiplexes the code of the linear prediction coefficients encoded by the linear prediction coefficient encoding unit 2, the adaptive excitation code output from the adaptive excitation encoding unit 3, the fixed excitation code output from the fixed excitation encoding unit 4, and the gain code output from the gain encoding unit 5 to produce speech code as the multiplexed result.

Upon receiving the speech code output from the speech encoding apparatus, the separating unit 21 included in the speech decoding apparatus separates it into the code of the linear prediction coefficients, the adaptive excitation code, the fixed excitation code, and the gain code which are then output to the linear prediction coefficient decoding unit 22, the adaptive excitation decoding unit 23, the fixed excitation decoding unit 24, and the gain decoding unit 25, respectively.

Upon receiving the code of the linear prediction coefficients from the separating unit 21, the linear prediction coefficient decoding unit 22 decodes the code and outputs the quantized values of the linear prediction coefficients to the synthesis filter 29 as the decode result.

The adaptive excitation decoding unit 23 has the built-in adaptive excitation code book storing past excitation signals having a predetermined length, and outputs an adaptive excitation signal (a time-series vector obtained as a result of repeating a past excitation signal) corresponding to the adaptive excitation code output from the separating unit 21.

On the other hand, the fixed excitation code book 31 included in the fixed excitation decoding unit 24 stores fixed code vectors which are noise-like time-series vectors, and outputs as a fixed excitation signal corresponding to the fixed excitation code output from the separating unit 21.

The gain decoding unit 25 has a built-in gain code book storing gain vectors, and outputs a gain vector corresponding to the gain code output from the separating unit 21.

The multipliers 26 and 27 multiply the adaptive excitation signal output from the adaptive excitation decoding unit 23 and the fixed excitation signal output from the fixed excitation decoding unit 24, respectively, by each element of the gain vector. Each respective pair of the multiplication results from the multipliers 26 and 27 are added together by the adder 28.

The synthesis filter 29 performs synthesis filtering processing on the excitation signal obtained as the addition result by the adder 28 to produce an output speech. It should be noted that the synthesis filter 29 uses the quantized values of the linear prediction coefficients decoded by the linear prediction coefficient decoding unit 22 as its filter coefficients.

Lastly, the adaptive excitation decoding unit 23 updates its built-in adaptive excitation code book by use of the above excitation signal.

Next, description will be made of conventional techniques for improving the above CELP-type speech encoding and speech decoding apparatuses.

The following two references propose methods for emphasizing the pitch property of an excitation signal for the purpose of obtaining high-quality speech even using a low bit rate.

Reference 1: Wang et al., "Improved excitation for phonetically-segmented VXC speech coding below 4 kb/s", Proc. GLOBECOM '90, pp. 946–950

Reference 2: JP-A No. 8-44397 (1996)

Furthermore, the following reference describes a speech encoding system which employs a similar method.

Reference 3: 3GPP Technical Specification 3G TS 26. 090

The ITU Recommendation G. 729 also describes a speech encoding system using another similar method.

FIG. 17 is a schematic diagram showing the internal configuration of a fixed excitation encoding unit 4 which emphasizes the pitch property of an excitation signal. Since the components in the figure which are the same as or correspond to those in FIG. 14 are denoted by like numerals, their explanation will be omitted. It should be noted that the configuration of the encoding system is the same as that shown in FIG. 13 except for the configuration of the fixed excitation encoding unit 4.

In FIG. 17, reference numeral 15 denotes a periodicity providing unit for giving a pitch property to a fixed code vector.

FIG. 18 is a schematic diagram showing the internal configuration of a fixed excitation decoding unit 24 which emphasizes the pitch property of an excitation signal. Since the component in the figure which is the same as or corresponds to that in FIG. 16 is denoted by a like numeral, its explanation will be omitted. It should be noted that the configuration of the decoding system is the same as that shown in FIG. 15 except for the configuration of the fixed excitation decoding unit 24.

In FIG. 18, reference numeral 32 denotes a periodicity providing unit for giving a pitch property to a fixed code vector.

The operations of the speech encoding and speech decoding apparatuses will be described below.

It should be noted that since the apparatuses are the same as the above described CELP-type speech encoding and speech decoding apparatuses except that the fixed excitation encoding unit 4 and the fixed excitation decoding unit 24 include the periodicity providing unit 15 and the periodicity providing unit 32, respectively, only their difference will be described.

The periodicity providing unit 15 emphasizes the pitch periodicity of a time-series vector output from the fixed excitation code book 11 before outputting the time-series vector.

The periodicity providing unit 32 emphasizes the pitch periodicity of a time-series vector output from the fixed excitation code book 31 before outputting the time-series vector.

The periodicity providing unit 15 and 32 use, for example, a comb filter to emphasize the pitch periodicity of a time-series vector.

The gain (periodicity emphasis coefficient) of the comb filter is set to a constant value in Reference 1, while the method employed in Reference 2 uses a long-term prediction gain of the speech signal in each frame to be encoded as a periodicity emphasis coefficient. The method proposed in Reference 3 uses a gain corresponding to an adaptive excitation signal encoded in each past frame.

The conventional speech encoding and speech decoding apparatuses are configured as described above so that their periodicity emphasis coefficient for emphasizing the pitch periodicity is set to a same value over all fixed code vectors. Therefore, when this periodicity emphasis coefficient is set to an inappropriate value, all the fixed code vectors are adversely affected, which makes it impossible to obtain sufficient quality improvement through periodicity emphasis, or which may even cause quality deterioration.

For example, consider a case in which even though a signal to be encoded indicates strong periodicity having a period of T, the periodicity emphasis coefficient is so set such that the impulse response of the comb filter for giving periodicity to fixed code vectors indicates weak periodicity. In such a case, the weak periodicity emphasis is applied to all fixed code vectors, producing large encoding distortion and thereby causing quality deterioration when the signal to encoded indicates strong periodicity.

On the other hand, the periodicity emphasis coefficient may be set so as to give strong periodicity to fixed code vectors when the signal to be encoded indicates weak periodicity. Also in this case, large code distortion is generated and thereby quality deterioration occurs.

In speech encoding, increasing the frame length is effective in increasing the information compression ratio. In such a case, however, since the frame is long, it easily happens that a frame to be analyzed includes unfavorable factors, such as a change in the pitch, which adversely affect proper calculation of the periodicity emphasis coefficient with the composition proposed in Reference 2. Furthermore, the correlation between the gain of a past frame and an appropriate periodicity emphasis coefficient for a current frame is reduced with the composition proposed in Reference 3. These events often cause the periodicity emphasis coefficient to be inappropriately set, worsening the problems described above.

Further, employing a plurality of fixed excitation code books which each store fixed code vectors of a different nature is also effective in increasing the information compression ratio in speech encoding. In this case, the appropriate periodicity emphasis coefficient is different from one fixed excitation code book to another, worsening the quality deterioration caused due to use of only a single periodicity emphasis coefficient.

For example, consider use of both a fixed excitation code book storing noise-like fixed code vectors and another fixed excitation code book storing non-noise-like (pulse-like) fixed code vectors which each store a small number of pulses in its frames. In the case of noise-like fixed code vectors, if they are constantly given strong periodicity, the speech quality of the output speech is improved with respect to noise characteristics. In the case of non-noise-like fixed code vectors, on the other hand, if they are constantly given strong periodicity, the output speech assumes pulse-like speech quality when intrinsically-nonperiodical noise-like input speech is applied, leading to subjective quality degradation.

Further, consider use of a fixed excitation code book storing fixed code vectors whose power distribution is biased, for example, only the first half of their frame includes signals and the second half does not include any signals (that is, include only a zero signal). In such a case, unless these fixed code vectors are given strong periodicity, the encoding characteristics of the second half of their frame is considerably deteriorated, degrading the subjective quality in the portion whose distributed power is small.

SUMMARY OF THE INVENTION

To solve the above problems, it is an object of the present invention to provide a speech encoding apparatus, a speech encoding method, a speech decoding apparatus, and a speech decoding method capable of obtaining an output speech of subjectively-high quality.

A speech encoding apparatus according to the present invention comprises: first periodicity providing means for, when encoding distortions of fixed code vectors are evaluated, emphasizing periodicity of a fixed code vector output from at least one fixed excitation code book by use of a first periodicity emphasis coefficient adaptively determined based on a predetermined rule; and second periodicity providing means for emphasizing periodicity of a fixed code vector output from at least one fixed excitation code book by use of a predetermined second periodicity emphasis coefficient.

A speech encoding method according to the present invention comprises: a first periodicity providing step of, when encoding distortions of fixed code vectors are evaluated, emphasizing periodicity of a fixed code vector output from at least one fixed excitation code book by use of a first periodicity emphasis coefficient adaptively determined based on a predetermined rule; and a second periodicity providing step of emphasizing periodicity of a fixed code vector output from at least one fixed excitation code book by use of a predetermined second periodicity emphasis coefficient.

A speech encoding method according to the present invention analyzes an input speech to determine a first periodicity emphasis coefficient.

A speech encoding method according to the present invention determines a first periodicity emphasis coefficient from speech code.

A speech encoding method according to the present invention decides a state of a speech, and determines a first periodicity emphasis coefficient based on the state decision result.

A speech encoding method according to the present invention determines a fricative section in a speech, and decreases an emphasis degree of a first periodicity emphasis coefficient in the fricative section.

A speech encoding method according to the present invention determines a steady voice section in a speech, and increases an emphasis degree of a first periodicity emphasis coefficient in the steady voice section.

A speech encoding method according to the present invention applies either a first periodicity providing step or a second periodicity providing step to a fixed excitation code book based on noise characteristics of fixed code vectors stored in the fixed excitation code book.

A speech encoding method according to the present invention applies either a first periodicity providing step or a second periodicity providing step to a fixed excitation code book based on power distribution of fixed code vectors in terms of time stored in the fixed excitation code book.

A speech decoding apparatus according to the present invention comprises: first periodicity providing means for, when a fixed code vector corresponding to fixed excitation code is extracted, emphasizing periodicity of a fixed code vector output from at least one fixed excitation code book by use of a first periodicity emphasis coefficient adaptively determined based on a predetermined rule; and second periodicity providing means for emphasizing periodicity of a fixed code vector output from at least one fixed excitation code book by use of a predetermined second periodicity emphasis coefficient.

A speech decoding method according to the present invention comprises: a first periodicity providing step of, when a fixed code vector corresponding to fixed excitation code is extracted, emphasizing periodicity of a fixed code vector output from at least one fixed excitation code book by use of a first periodicity emphasis coefficient adaptively determined based on a predetermined rule; and a second periodicity providing step of emphasizing periodicity of a fixed code vector output from at least one fixed excitation code book by use of a predetermined second periodicity emphasis coefficient.

A speech decoding method according to the present invention decodes a first periodicity emphasis coefficient from code of a periodicity emphasis coefficient included in speech code.

A speech decoding method according to the present invention determines a first periodicity emphasis coefficient from speech code.

A speech decoding method according to the present invention decides a state of a speech, and determines a first periodicity emphasis coefficient based on the state decision result.

A speech decoding method according to the present invention determines a fricative section in a speech, and decreases an emphasis degree of a first periodicity emphasis coefficient in the fricative section.

A speech decoding method according to the present invention determines a steady voice section in a speech, and increases an emphasis degree of a first periodicity emphasis coefficient in the steady voice section.

A speech decoding method according to the present invention applies either a first periodicity providing step or a second periodicity providing step to a fixed excitation code book based on noise characteristics of fixed code vectors stored in the fixed excitation code book.

A speech decoding method according to the present invention applies either a first periodicity providing step or a second periodicity providing step to a fixed excitation code book based on power distribution of fixed code vectors in terms of time stored in the fixed excitation code book.

DETAILED DESCRIPTION OF THE PREFERRED EMBODIMENTS

Preferred embodiments of the present invention will be described below.

(First Embodiment)

Figure 1:
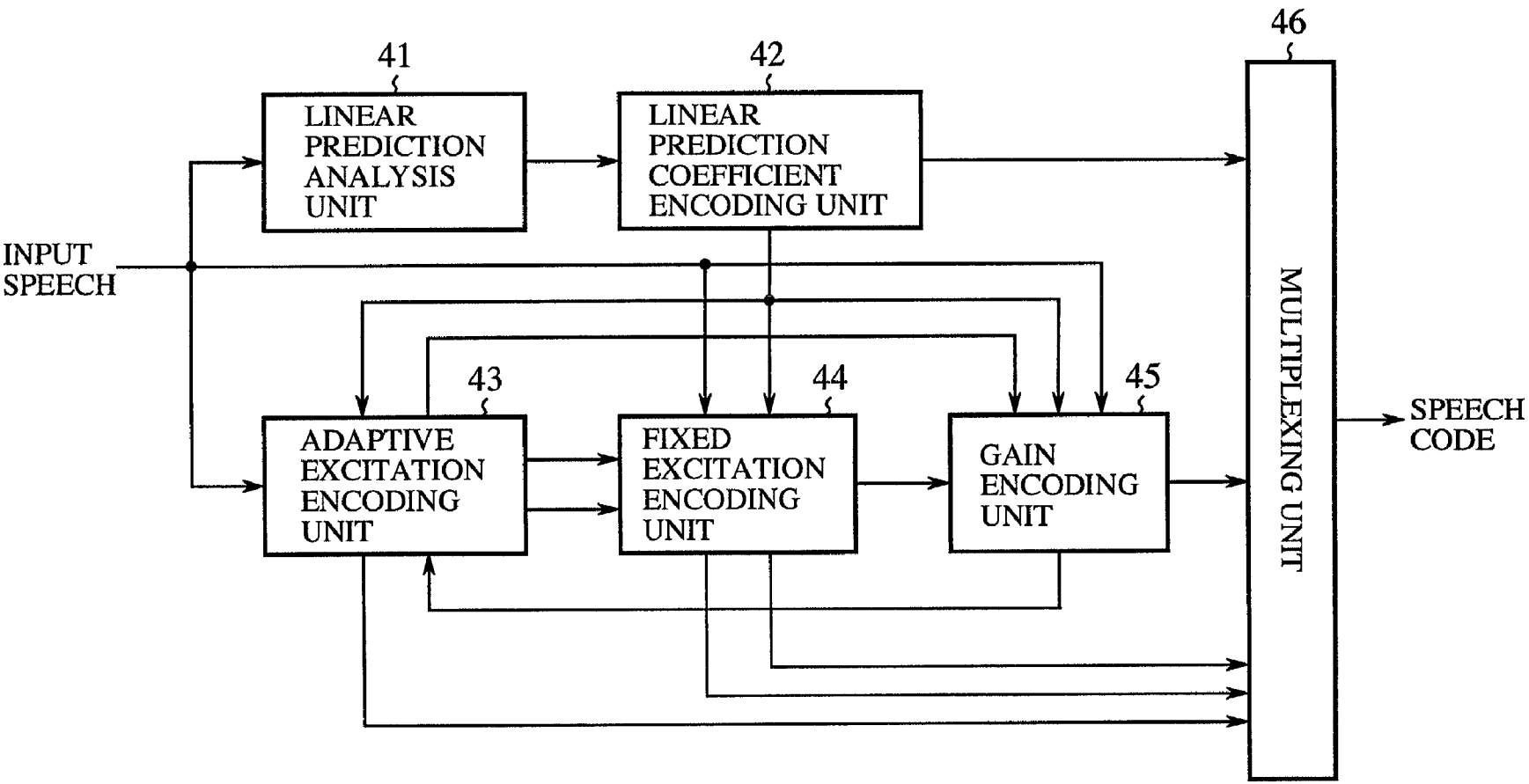
FIG. 1 is a schematic diagram showing the configuration of a speech encoding apparatus according to a first embodiment of the present invention.

FIG. 1 is a schematic diagram showing the configuration of a speech encoding apparatus according to a first embodiment of the present invention. In the figure, reference numeral 41 denotes a linear prediction analysis unit for analyzing an input speech and extracting linear prediction coefficients, which denote spectral envelope information of the input speech, while reference numeral 42 denotes a linear prediction coefficient encoding unit for encoding the linear prediction coefficients extracted by the linear prediction analysis unit 41 and outputting the resultant code to a multiplexing unit 46 as well as outputting quantized values of the linear prediction coefficients to an adaptive excitation encoding unit 43, a fixed excitation encoding unit 44, and a gain encoding unit 45.

It should be noted that the linear prediction coefficient analysis unit 41 and the linear prediction coefficient encoding unit 42 collectively constitute a spectral envelope information encoding unit.

Reference numeral 43 denotes the adaptive excitation encoding unit for: generating a tentative synthesized speech by use of the quantized values of the linear prediction coefficients output from the linear prediction coefficient encoding unit 42; selecting adaptive excitation code with which the distance between the tentative synthesized speech and the input speech is minimized; outputting the thus selected adaptive excitation code to the multiplexing unit 46; and outputting to the gain encoding unit 45 an adaptive excitation signal (a time-series vector obtained as a result of repeating a past excitation signal having a given length) corresponding to the adaptive excitation code. Reference numeral 44 denotes the fixed excitation encoding unit for: analyzing the input speech to obtain a periodicity emphasis coefficient; encoding the periodicity emphasis coefficient and outputting the resultant code to the multiplexing unit 46; generating a tentative synthesized speech by use of both the quantized value of the periodicity emphasis coefficient and the quantized values of the linear prediction coefficients output from the linear prediction coefficient encoding unit 42; selecting fixed excitation code with which the distance between the tentative synthesized speech and a signal to be encoded (a signal obtained as a result of subtracting from the input speech the synthesized speech produced based on the adaptive excitation signal) is minimized and outputting the thus selected fixed excitation code to the multiplexing unit 46; and outputting to the gain encoding unit 45 a fixed excitation signal which is a time-series vector corresponding to the fixed excitation code.

Reference numeral 45 denotes the gain encoding unit for: multiplying both the adaptive excitation signal output from the adaptive excitation encoding unit 43 and the fixed excitation signal output from the fixed excitation encoding unit 44 by each element of a gain vector; adding each respective pair of the multiplication results together to generate an excitation signal; generating a tentative synthesized speech from the generated excitation signal by use of the quantized values of the linear prediction coefficients output from the linear prediction coefficient encoding unit 42; and selecting gain code with which the distance between the tentative synthesized speech and the input speech is minimized and outputting the selected gain code to the multiplexing unit 46.

It should be noted that the adaptive excitation encoding unit 43, the fixed excitation encoding unit 44, and the gain encoding unit 45 collectively constitute an excitation information encoding unit.

Reference numeral 46 denotes the multiplexing unit for multiplexing the code of the linear prediction coefficients encoded by the linear prediction coefficient encoding unit 42, the adaptive excitation code output from the adaptive excitation encoding unit 43, the code of the periodicity emphasis coefficient and the fixed excitation code output from the fixed excitation encoding unit 44, and the gain code output from the gain encoding unit 45 so as to produce speech code.

Figure 2:
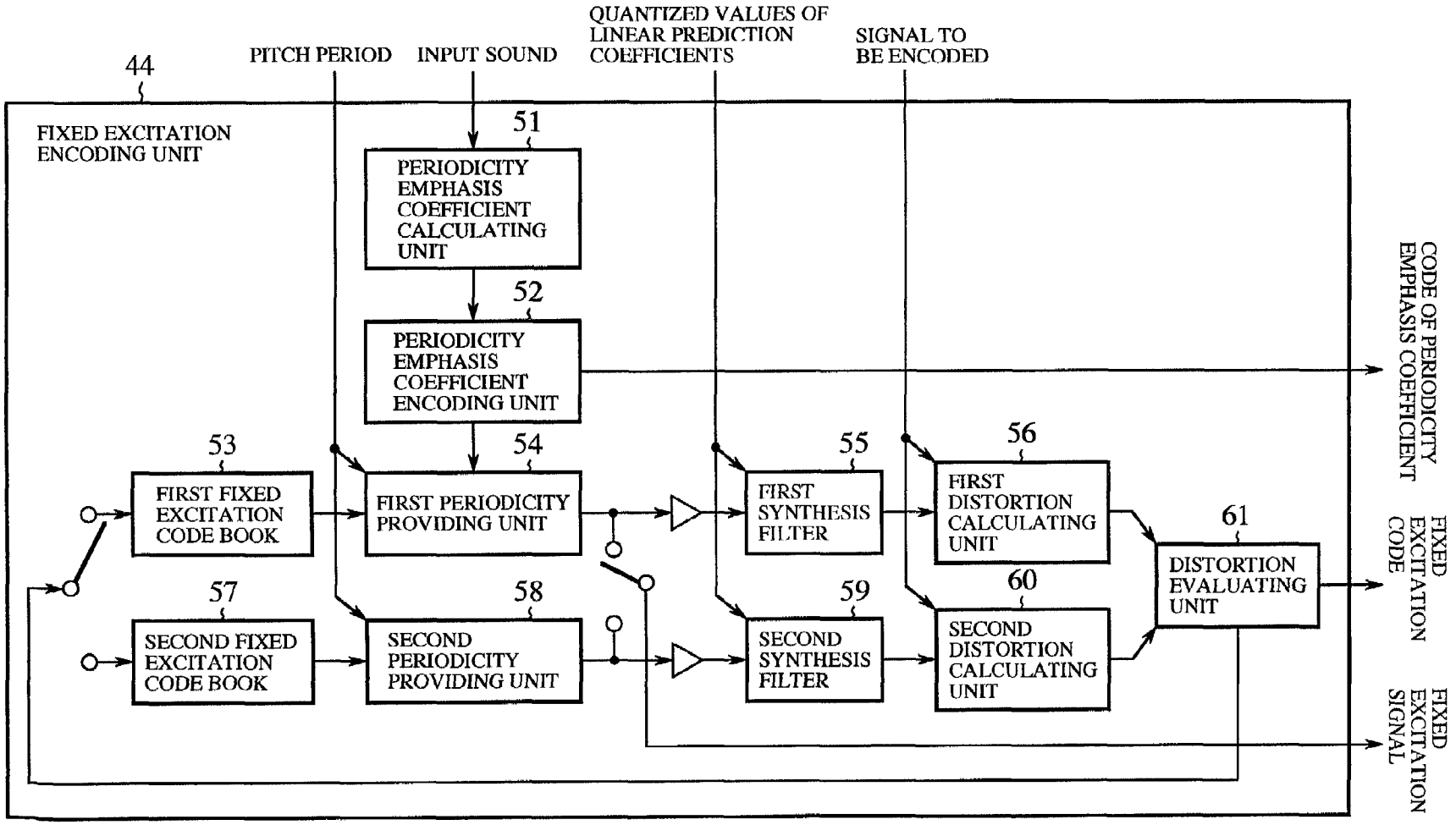
FIG. 2 is a schematic diagram showing the internal configuration of a fixed excitation encoding unit.

FIG. 2 is a schematic diagram showing the internal configuration of the fixed excitation encoding unit 44. In the figure, reference numeral 51 denotes a periodicity emphasis coefficient calculating unit for analyzing the input speech to determine a periodicity emphasis coefficient (a first periodicity emphasis coefficient); 52 a periodicity emphasis coefficient encoding unit for encoding the periodicity emphasis coefficient determined by the periodicity emphasis coefficient calculating unit 51 and outputting a quantized value of the periodicity emphasis coefficient to a first periodicity providing unit 54; 53 a first fixed excitation code book for storing a plurality of non-noise-like (pulse-like) time-series vectors (fixed code vectors); 54 the first periodicity providing unit for emphasizing the periodicity of each time-series vector by use of the quantized value of the periodicity emphasis coefficient output from the periodicity emphasis coefficient encoding unit 52; 55 a first synthesis filter for generating a tentative synthesized speech for each time-series vector by use of the quantized values of the linear prediction coefficients output from the linear prediction coefficient encoding unit 42; and 56 a first distortion calculating unit for calculating the distance between the tentative synthesized speech and the signal to be encoded output from the adaptive excitation encoding unit 43.

Reference numeral 57 denotes a second fixed excitation code book for storing a plurality of noise-like time-series vectors (fixed code vectors); 58 a second periodicity providing unit for emphasizing the periodicity of each time-series vector by use of a predetermined fixed periodicity emphasis coefficient (a second periodicity emphasis coefficient); 59 a second synthesis filter for generating a tentative synthesized speech for each time-series vector by use of the quantized values of the linear prediction coefficients output from the linear prediction coefficient encoding unit 42; 60 a second distortion calculating unit for calculating the distance between the tentative synthesized speech and the signal to be encoded output from the adaptive excitation encoding unit 43; and 61 a distortion evaluating unit for comparing and evaluating the calculation result from the first distortion calculating unit 56 and the calculation result from the second distortion calculating unit 60 to select fixed excitation code.

Figure 3:
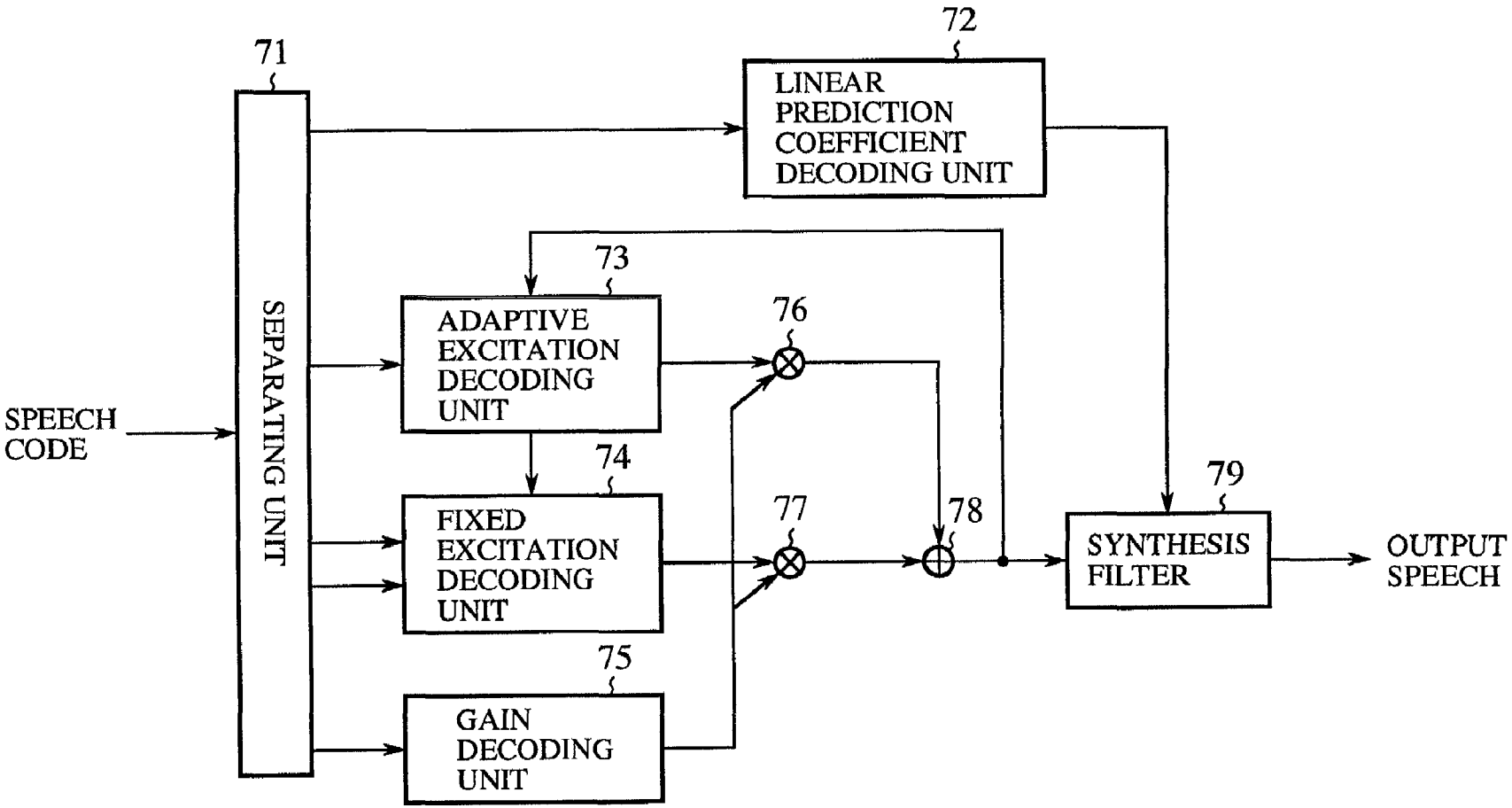
FIG. 3 is a schematic diagram showing the configuration of a speech decoding apparatus according to the first embodiment of the present invention.

FIG. 3 is a schematic diagram showing the configuration of a speech decoding apparatus according to the first embodiment of the present invention. In the figure, reference numeral 71 denotes a separating unit for separating the speech code output from the speech encoding apparatus into the code of the linear prediction coefficients, the adaptive excitation code, the code of the periodicity emphasis coefficient and the fixed excitation code, and the gain code which are then supplied to a linear prediction coefficient decoding unit 72, an adaptive excitation decoding unit 73, a fixed excitation decoding unit 74, and a gain decoding unit 75, respectively. Reference numeral 72 denotes the linear prediction coefficient decoding unit for decoding the code of the linear prediction coefficients output from the separating unit 71 and outputting the decoded quantized values of the linear prediction coefficients to a synthesis filter 79.

Reference numeral 73 denotes the adaptive excitation decoding unit for outputting an adaptive excitation signal (a time-series vector obtained as a result of repeating a past excitation signal) corresponding to the adaptive excitation code output from the separating unit 71, while reference numeral 74 denotes the fixed excitation decoding unit for outputting a fixed excitation signal (a time-series vector) corresponding to both the code of the periodicity emphasis coefficient and the fixed excitation code output from the separating unit 71. Reference numeral 75 denotes the gain decoding unit for outputting a gain vector corresponding to the gain code output from the separating unit 71.

Reference numeral 76 denotes a multiplier for multiplying the adaptive excitation signal output from the adaptive excitation decoding unit 73 by an element of the gain vector output from the gain decoding unit 75, while reference numeral 77 denotes another multiplier for multiplying the fixed excitation signal output from the fixed excitation decoding unit 74 by another element of the gain vector output from the gain decoding unit 75. Reference numeral 78 denotes an adder for adding the multiplication result of the multiplier 76 and the multiplication result of the multiplier 77 together to generate an excitation signal. Reference numeral 79 denotes the synthesis filter for performing synthesis filtering processing on the excitation signal generated by the adder 78 to produce an output speech.

Figure 4:
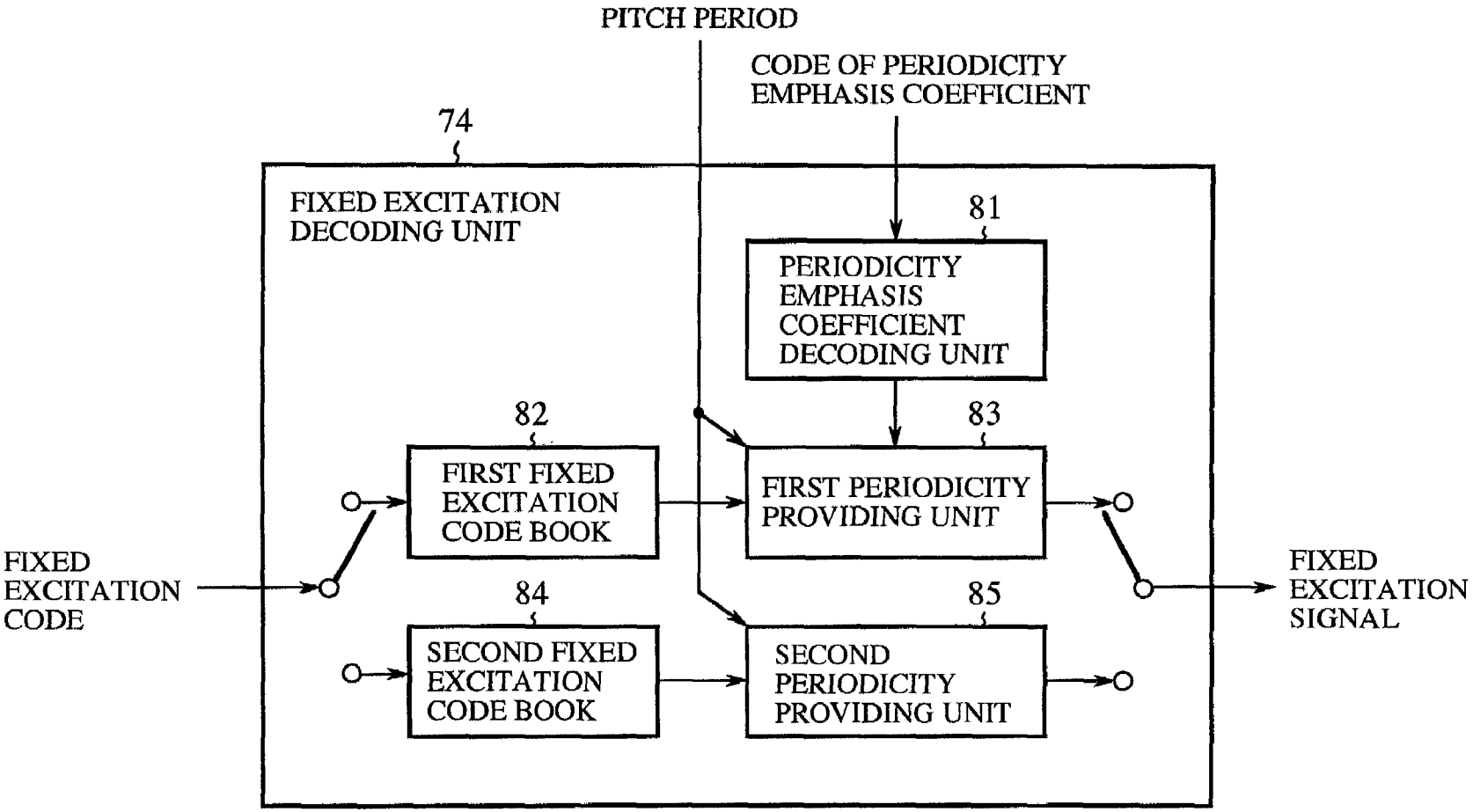
FIG. 4 is a schematic diagram showing the internal configuration of a fixed excitation decoding unit.

FIG. 4 is a schematic diagram showing the internal configuration of the fixed excitation decoding unit 74. In the figure, reference numeral 81 denotes a periodicity emphasis coefficient decoding unit for decoding the code of the periodicity emphasis coefficient output from the separating unit 71 and outputting the decoded quantized value of the periodicity emphasis coefficient (the first periodicity emphasis coefficient) to a first periodicity providing unit 83; 82 a first fixed excitation code book for storing a plurality of non-noise-like (pulse-like) time-series vectors (fixed code vectors); 83 the first periodicity providing unit for emphasizing each time-series vector by use of the quantized value of the periodicity emphasis coefficient output from the periodicity emphasis coefficient decoding unit 81; 84 a second fixed excitation code book for storing a plurality of noise-like time-series vectors (fixed code vectors); 85 a second periodicity providing unit for emphasizing the periodicity of each time-series vector by use of the predetermined fixed periodicity emphasis coefficient (the second periodicity emphasis coefficient).

The operations of the speech encoding and speech decoding apparatuses will be described below.

The speech encoding apparatus performs processing in units of frames each having a time duration of approximately 5 to 50 ms.

First, description will be made of encoding of spectral envelope information.

Upon receiving a speech, the linear prediction analysis unit 41 analyzes the input speech and extracts linear prediction coefficients, which are spectral envelope information on the speech.

After the linear prediction analysis unit 41 has extracted the linear prediction coefficients, the linear prediction coefficient encoding unit 42 encodes the linear prediction coefficients and outputs the code to the multiplexing unit 46.

The linear prediction coefficient encoding unit 42 also outputs quantized values of the linear prediction coefficients to the adaptive excitation encoding unit 43, the fixed excitation encoding unit 44, and the gain encoding unit 45.

Next, description will be made of encoding of excitation information.

The adaptive excitation encoding unit 43 has a built-in adaptive excitation code book storing past excitation signals having a predetermined length, and generates a time-series vector which is obtained as a result of periodically repeating a past excitation signal, based on each internally-generated adaptive excitation code (indicated by a binary number having a few bits).

The adaptive excitation encoding unit 43 then multiplies each time-series vector by each appropriate gain value, and generates a tentative synthesized speech by passing the time-series vector through the synthesis filter which uses the quantized values of the linear prediction coefficients output from the linear prediction coefficient encoding unit 42.

Furthermore, the adaptive excitation encoding unit 43 evaluates, for example, the distance between the tentative synthesized speech and the input speech to obtain the encoding distortion, and selects and outputs to the multiplexing unit 46 adaptive excitation code with which the distance is minimized. The adaptive excitation encoding unit 43 also outputs to the gain encoding unit 45 a time-series vector corresponding to the selected adaptive excitation code as an adaptive excitation signal as well as outputting to the fixed excitation encoding unit 44 both a pitch period corresponding to the selected adaptive excitation code and a signal (to be encoded) obtained as a result of subtracting from the input speech a synthesized speech produced based on the adaptive excitation signal.

Next, the operation of the fixed excitation encoding unit 44 will be described.

The periodicity emphasis coefficient calculating unit 51 analyzes the input speech to determine a periodicity emphasis coefficient.

For example, the periodicity emphasis coefficient is determined based on a long-term prediction gain of the input speech as follows. If the spectral characteristics are determined to be voiced, the degree of the emphasis is increased. If they are determined to be unvoiced, on the other hand, the degree of the emphasis is decreased. Furthermore, if the long-term prediction gain and the pitch period exhibit a small change in terms of time, the degree of the emphasis is increased. If they show a large change in terms of time, on the other hand, the degree of the emphasis is decreased.

After the periodicity emphasis coefficient calculating unit 51 has determined the periodicity emphasis coefficient, the periodicity emphasis coefficient encoding unit 52 encodes the periodicity emphasis coefficient and outputs the code to the multiplexing unit 46 as well as outputting a quantized value of the periodicity emphasis coefficient to the first periodicity providing unit 54.

The first fixed excitation code book 53 stores a plurality of fixed code vectors which are non-noise-like (pulse-like) time-series vectors, and sequentially outputs a time-series vector according to each fixed excitation code output from the distortion evaluating unit 61. The first periodicity providing unit 54 emphasizes the periodicity of a time-series vector output from the first fixed excitation code book 53 by use of the quantized value of the periodicity emphasis coefficient output from the periodicity emphasis coefficient encoding unit 52. The first periodicity providing unit 54 uses, for example, a comb filter to emphasize the periodicity of each time-series vector.

Each time-series vector is then multiplied by an appropriate gain value and input to the first synthesis filter 55.

The first synthesis filter 55 uses the quantized values of the linear prediction coefficients output from the linear prediction coefficient encoding unit 42 to generate a tentative synthesized speech based on each gain-multiplied time-series vector.

The first distortion calculating unit 56 calculates, for example, the distance between the tentative synthesized speech and the signal to be encoded output from the adaptive excitation encoding unit 43 as the encoding distortion and outputs it to the distortion evaluating unit 61.

On the other hand, the second fixed excitation code book 57 stores a plurality of fixed code vectors which are noise-like time-series vectors, and sequentially outputs a time-series vector according to each fixed excitation code output from the distortion evaluating unit 61. The second periodicity providing unit 58 emphasizes the periodicity of the time-series vector output from the second fixed excitation code book 57 before outputting the time-series vector. The second periodicity providing unit 58 uses, for example, a comb filter to emphasize the periodicity of each time-series vector.

The fixed periodicity emphasis coefficient used by the second periodicity providing unit 58 is predetermined using, for example, a method which applies and encodes a learning input speech. In the method, frames are extracted to which application of the periodicity emphasis coefficient used by the first periodicity providing unit 54 is not appropriate, and the fixed periodicity emphasis coefficient used by the second periodicity providing unit 58 is determined such that the average encoding quality of the extracted frames is high.

Each periodicity-emphasized time-series vector is then multiplied by an appropriate gain value and input to the second synthesis filter 59.

The second synthesis filter 59 uses the quantized values of the linear prediction coefficients output from the linear prediction coefficient encoding unit 42 to generate a tentative synthesized speech based on each gain-multiplied time-series vector.

The second distortion calculating unit 60 calculates the distance between the tentative synthesized speech and the signal to be encoded which is input from the adaptive excitation encoding unit 43, and outputs the distance to the distortion evaluating unit 61.

The distortion evaluating unit 61 selects and outputs to the multiplexing unit 46 fixed excitation code with which the distance between the above tentative synthesized speech and signal to be encoded is minimized. Furthermore, the distortion evaluating unit 61 directs the first fixed excitation code book 53 or the second fixed excitation code book 57 to output a time-series vector corresponding to the selected fixed excitation code. The first periodicity providing unit 54 or the second periodicity providing unit 58 emphasizes the pitch periodicity of the time-series vector output from the first fixed excitation code book 53 or the second fixed excitation code book 57, respectively, and outputs it to the gain encoding unit 45 as a fixed excitation signal. After the fixed excitation encoding unit 44 has outputted the fixed excitation signal as described above, the gain encoding unit 45, which has a built-in gain code book storing gain vectors, sequentially reads a gain vector from the gain code book according to each internally-generated gain code (indicated by a binary number having a few bits).

The gain encoding unit 45 multiplies both the adaptive excitation signal output from the adaptive excitation encoding unit 43 and the fixed excitation signal output from the fixed excitation encoding unit 44 by each element of the gain vector, and adds each respective pair of the multiplication results together to generate an excitation signal.

The gain encoding unit 45 then generates a tentative synthesized speech by passing the excitation signal through a synthesis filter which uses the quantized values of the linear prediction coefficients output from the linear prediction coefficient encoding unit 42.

Furthermore, the gain encoding unit 45 evaluates, for example, the distance between the tentative synthesized speech and the input speech to obtain the encoding distortion, selects and outputs to the multiplexing unit 46 gain code with which the distance is minimized, and outputs to the adaptive excitation encoding unit 43 an excitation signal corresponding to the gain code. Then, the adaptive excitation encoding unit 43 uses the excitation signal, which is selected by the gain encoding unit 45 and corresponds to the gain code, to update its built-in adaptive excitation code book.

The multiplexing unit 46 multiplexes the code of the linear prediction coefficients encoded by the linear prediction coefficient encoding unit 42, the adaptive excitation code output from the adaptive excitation encoding unit 43, the code of the periodicity emphasis coefficient and the fixed excitation code output from the fixed excitation encoding unit 44, and the gain code output from the gain encoding unit 45 to produce speech code as the multiplexed result.

Upon receiving the speech code output from the speech encoding apparatus, the separating unit 71 included in the speech decoding apparatus separates it into the code of the linear prediction coefficients, the adaptive excitation code, the code of the periodicity emphasis coefficient and the fixed excitation code, and the gain code. The separating unit 71 outputs the code of the linear prediction coefficients, the adaptive excitation code, and the gain code to the linear prediction coefficient decoding unit 72, the adaptive excitation decoding unit 73, and the gain decoding unit 75, respectively, and outputs the code of the periodicity emphasis coefficient and the fixed excitation code to the fixed excitation decoding unit 74.

Upon receiving the code of the linear prediction coefficients from the separating unit 71, the linear prediction coefficient decoding unit 72 decodes the code and outputs the decoded quantized values of the linear prediction coefficients to the synthesis filter 79.

The adaptive excitation decoding unit 73 has the built-in adaptive excitation code book storing past excitation signals having a predetermined length, and outputs the adaptive excitation signal (a time-series vector obtained as a result of repeating a past excitation signal) corresponding to the adaptive excitation code output from the separating unit 71.

Next, the operation of the fixed excitation decoding unit 74 will now be described.

Upon receiving the code of the periodicity emphasis coefficient from the separating unit 71, the periodicity emphasis coefficient decoding unit 81 decodes the code and outputs the decoded quantized value of the periodicity emphasis coefficient to the periodicity providing unit 83.

The first fixed excitation code book 82 stores a plurality of non-noise-like (pulse-like) time-series vectors, while the second fixed excitation code book 84 stores a plurality of noise-like time-series vectors. The first fixed excitation code book 82 or the second excitation code book 84 outputs a time-series vector corresponding to the fixed excitation code output from the separating unit 71.

If the first fixed excitation code book 82 has outputted the time-series vector corresponding to the fixed excitation code, the first periodicity providing unit 83 emphasizes the periodicity of the time-series vector output from the first fixed excitation code book 82 by use of the quantized value of the periodicity emphasis coefficient output from the periodicity emphasis coefficient decoding unit 81, and outputs the time-series vector as a fixed excitation signal.

If the second fixed excitation code book 84 has outputted the time-series vector corresponding to the fixed excitation code, on the other hand, the second periodicity providing unit 85 emphasizes the periodicity of the time-series vector output from the second fixed excitation code book 84 by use of the predetermined fixed periodicity emphasis coefficient, and outputs the time-series vector as a fixed excitation signal.

The gain decoding unit 75 has a built-in gain code book storing gain vectors, and outputs a gain vector corresponding to the gain code output from the separating unit 71.

The multipliers 76 and 77 multiply the adaptive excitation signal output from the adaptive excitation decoding unit 73 and the fixed excitation signal output from the fixed excitation decoding unit 74, respectively, by each element of the gain vector. Each respective pair of the multiplication results from the multipliers 76 and 77 are added together by the adder 78.

The synthesis filter 79 performs synthesis filtering processing on the excitation signal obtained as the addition result by the adder 78 to produce an output speech. It should be noted that the synthesis filter 79 uses the quantized values of the linear prediction coefficients decoded by the linear prediction coefficient decoding unit 72 as its filter coefficients.

Lastly, the adaptive excitation decoding unit 73 updates its built-in adaptive excitation code book by use of the above excitation signal.

Figure 5:
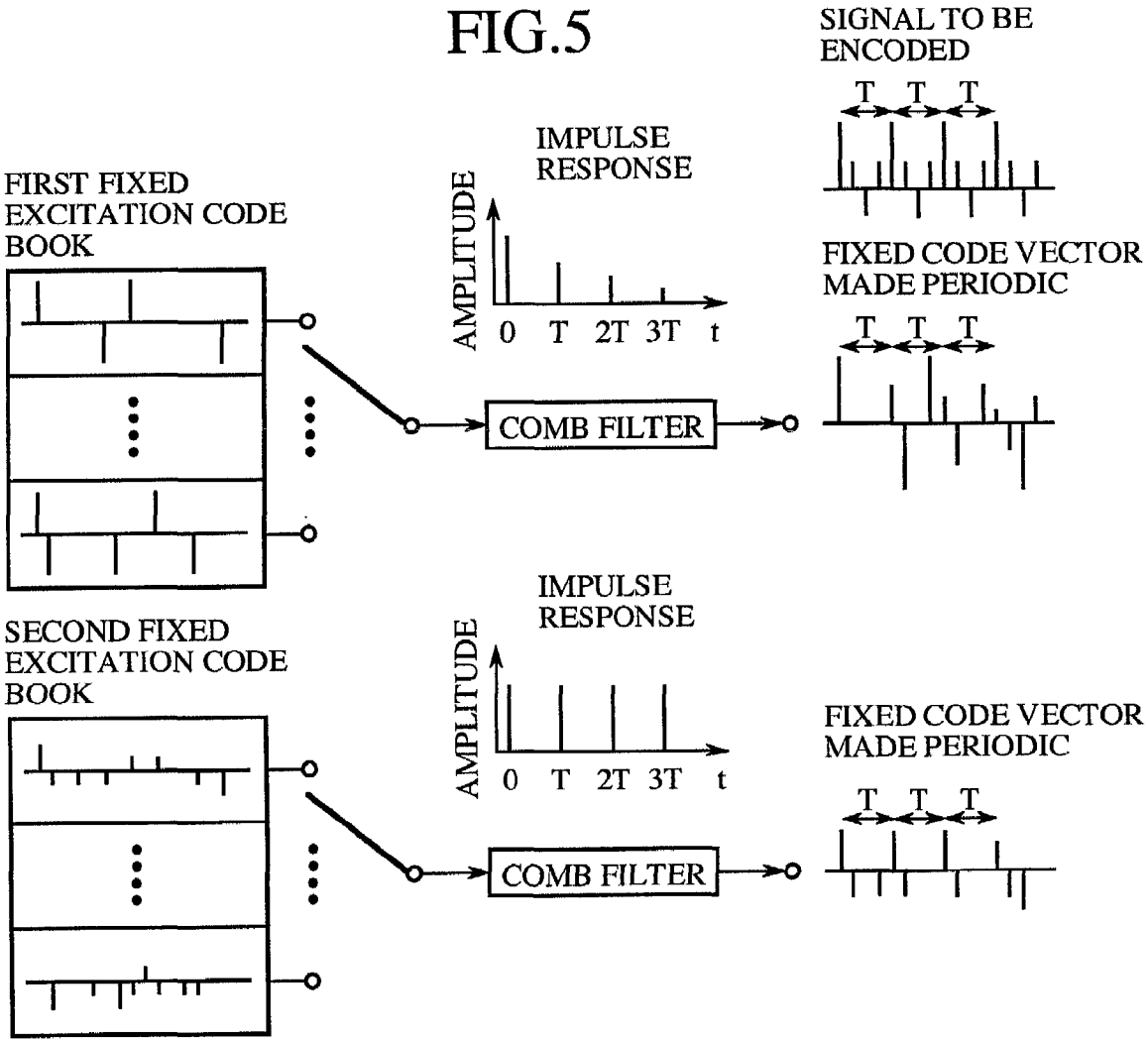
FIG. 5 is a schematic diagram illustrating periodicity emphasis for fixed code vectors.

As can be seen from the above description, the first embodiment comprises: first periodicity providing unit for, when encoding distortions of fixed code vectors are evaluated, emphasizing periodicity of a fixed code vector output from at least one fixed excitation code book by use of a first periodicity emphasis coefficient adaptively determined based on a predetermined rule; and second periodicity providing unit for emphasizing periodicity of a fixed code vector output from at least one fixed excitation code book by use of a predetermined second periodicity emphasis coefficient. Therefore, as shown in FIG. 5, when one of the first periodicity emphasis coefficient and the second periodicity emphasis coefficient has been set to an inappropriate value, it is possible to limit the adverse influence by the inappropriate periodicity emphasis to part of the fixed code vectors, thereby obtaining an output speech of subjectively-high quality.

Further, the first embodiment is configured such that a first periodicity emphasis coefficient is determined based on a parameter obtainable from analyzing an input speech. Therefore, it is possible to determine a periodicity emphasis coefficient based on a fine rule using a large number of parameters extractable from the input speech. With this arrangement, it is possible to reduce the frequency of determination of an inappropriate periodicity emphasis coefficient, thereby obtaining an output speech of subjectively-high quality.

Still further, the first embodiment applies either a first periodicity providing step or a second periodicity providing step to a fixed excitation code book based on noise characteristics of fixed code vectors stored in the fixed excitation code book. Therefore, it is possible to constantly give strong periodicity to a noise-like fixed code vector, improving the speech quality of the output speech with respect to noise characteristics. It is also possible to prevent constant application of strong periodicity to a non-noise-like vector so as to prevent the output speech from assuming pulse-like speech quality, thereby obtaining an encoded speech of subjectively-high quality.

(Second Embodiment)

Figure 6:
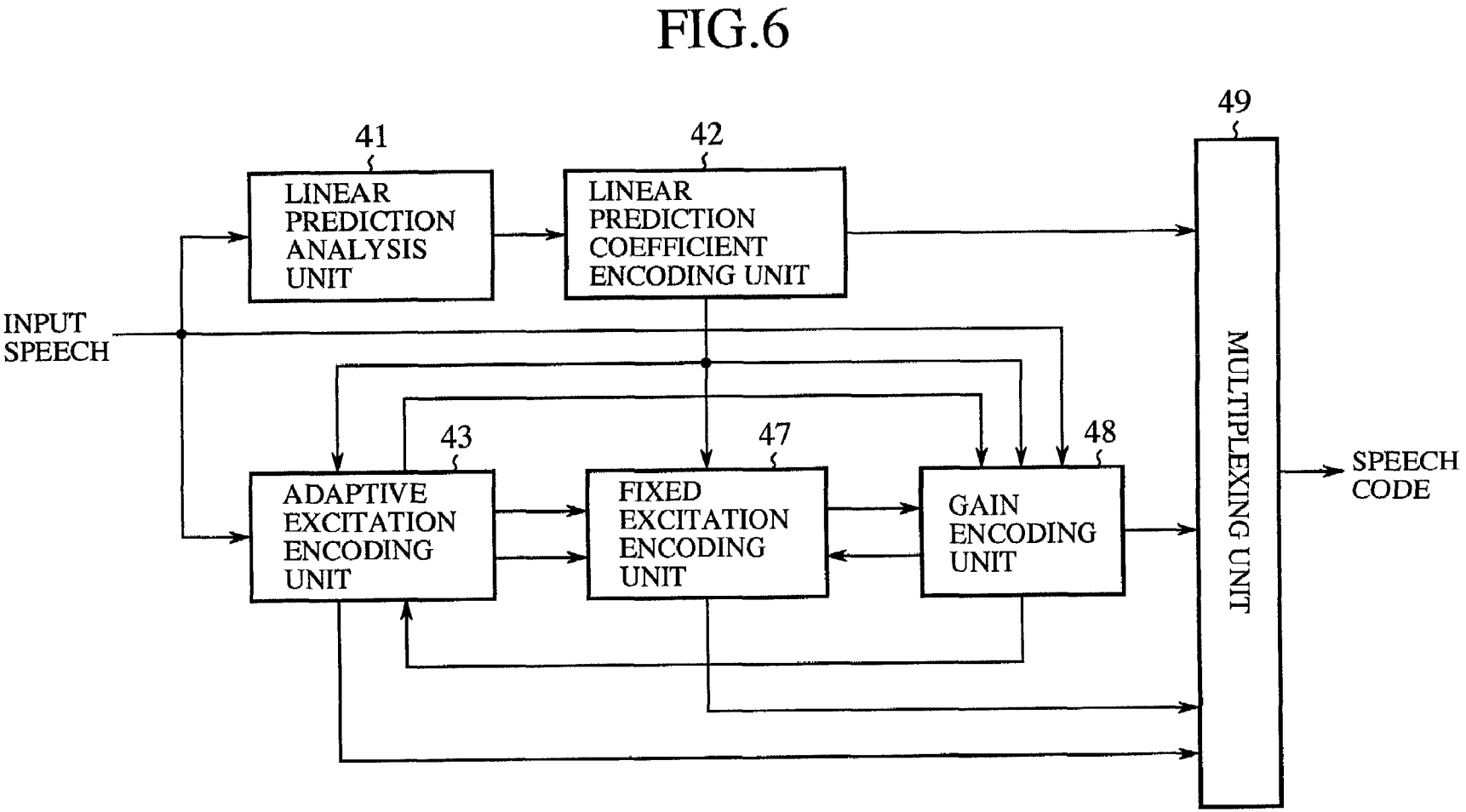
FIG. 6 is a schematic diagram showing the configuration of a speech encoding apparatus according to a second embodiment of the present invention.

FIG. 6 is a schematic diagram showing the configuration of a speech encoding apparatus according to a second embodiment of the present invention. Since the components in the figure which are the same as or correspond to those in FIG. 1 are denoted by like numerals, their explanation will be omitted.

Reference numeral 47 denotes a fixed excitation encoding unit for: determining a periodicity emphasis coefficient from the gain of an adaptive excitation signal; generating a tentative synthesized speech by use of both the periodicity emphasis coefficient and quantized values of linear prediction coefficients output from the linear prediction coefficient encoding unit 42;selecting fixed excitation code with which the distance between the tentative synthesized speech and a signal to be encoded (a signal obtained as a result of subtracting from the input speech a synthesized speech produce based on the adaptive excitation signal) is minimized and outputting the selected fixed excitation code to the multiplexing unit 49; and outputting to the gain encoding unit 48 a fixed excitation signal which is a time-series vector corresponding to the fixed excitation code.

Reference numeral 48 denotes a gain encoding unit for: multiplying both the adaptive excitation signal output from the adaptive excitation encoding unit 43 and the fixed excitation signal output from the fixed excitation encoding unit 47 by each element of a gain vector; adding each respective pair of the multiplication results together to generate an excitation signal; generating a tentative synthesized speech from the generated excitation signal by use of the quantized values of the linear prediction coefficients output from the linear prediction coefficient encoding unit 42; and selecting gain code with which the distance between the tentative synthesized speech and the input speech is minimized and outputting the selected gain code to the multiplexing unit 49.

Figure 7:
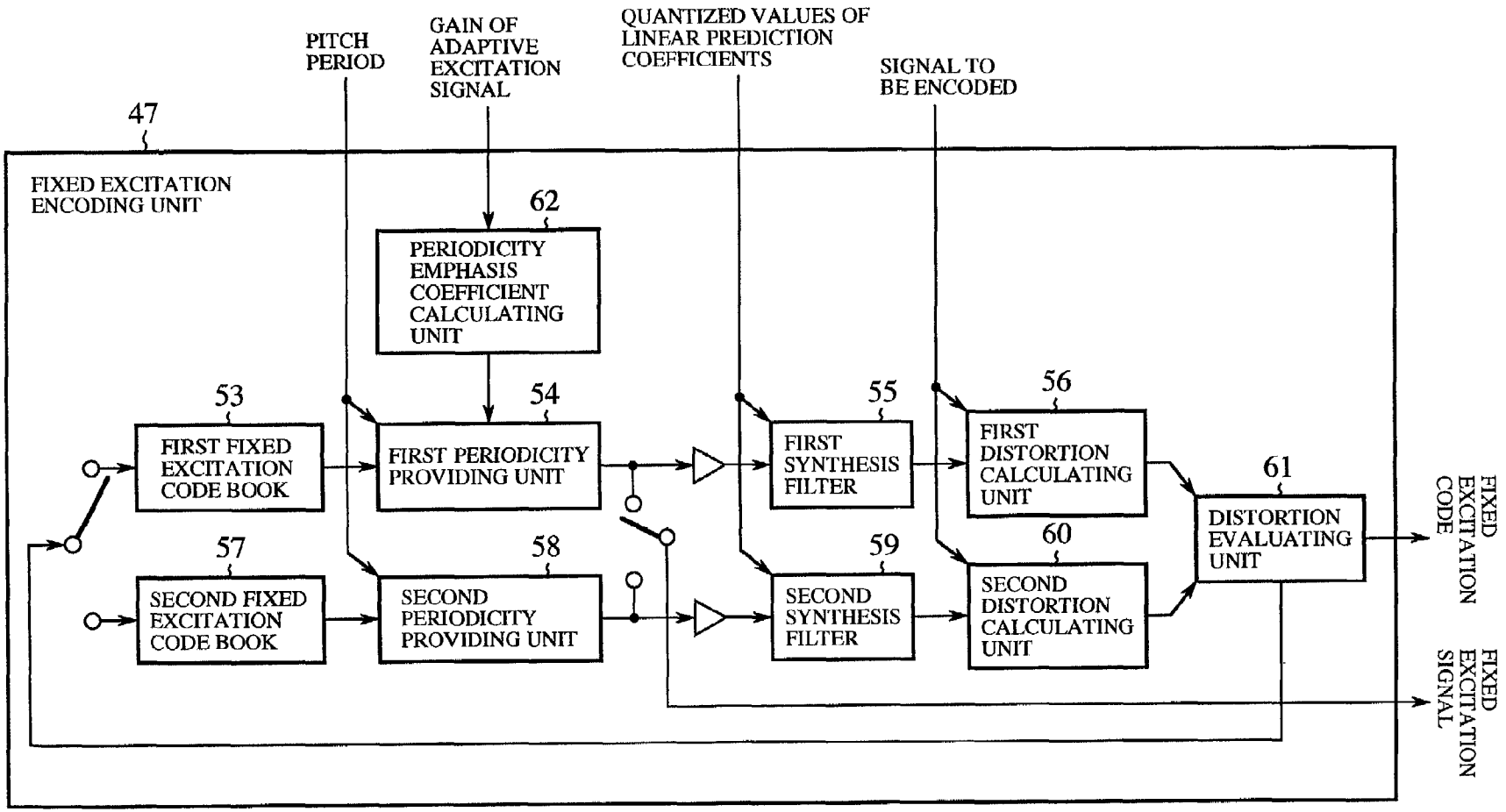
FIG. 7 is a schematic diagram showing the internal configuration of a fixed excitation encoding unit.

FIG. 7 is a schematic diagram showing the internal configuration of the fixed excitation encoding unit 47. Since the components in the figure which are the same as or corresponding to those in FIG. 2 are denoted by like numerals, their explanation will be omitted.

Reference numeral 62 denotes a periodicity emphasis coefficient calculating unit for determining a periodicity emphasis coefficient from the gain of an adaptive excitation signal.

Figure 8:
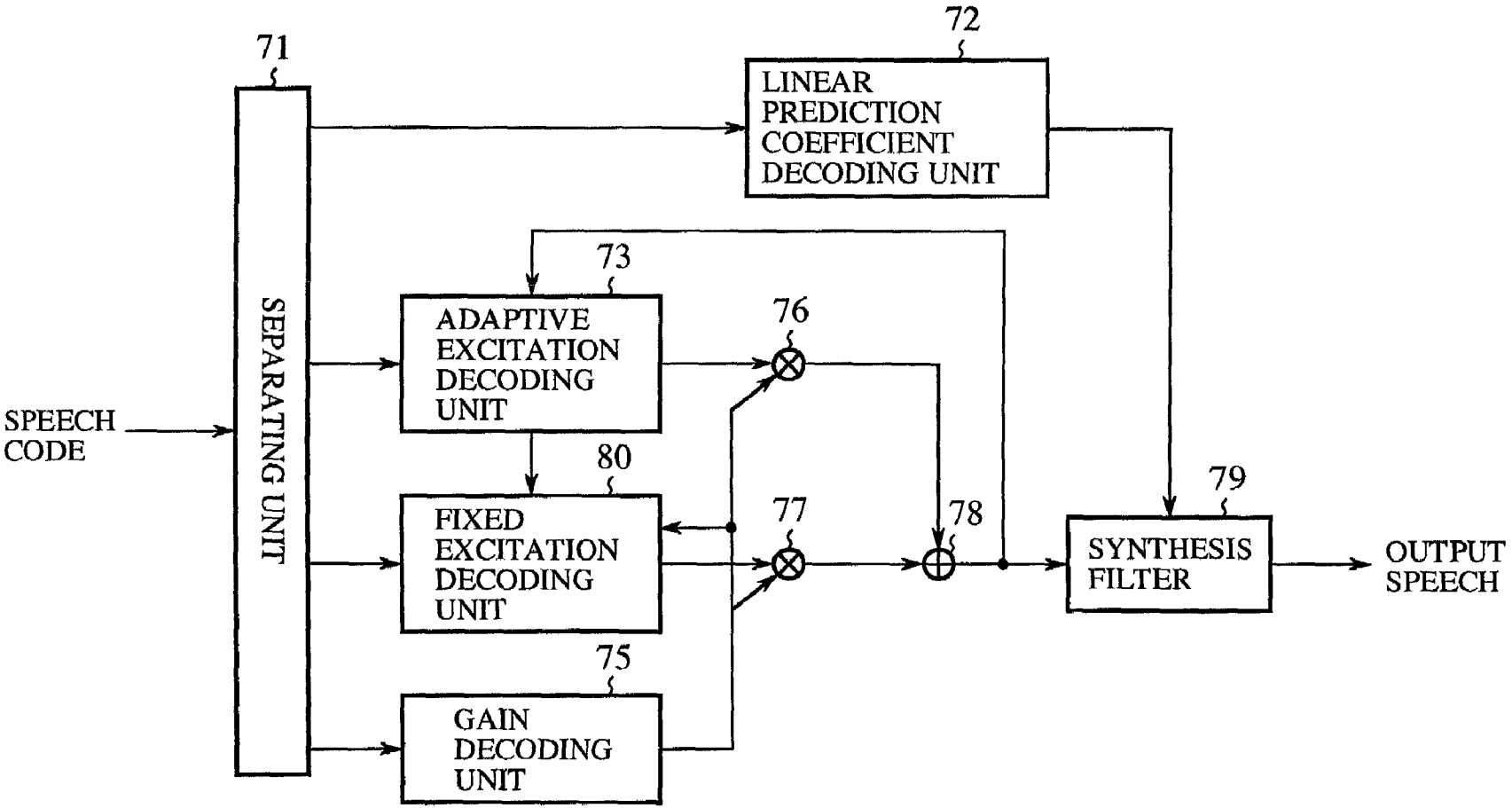
FIG. 8 is a schematic diagram showing the configuration of a speech decoding apparatus according to the second embodiment of the present invention.

FIG. 8 is a schematic diagram showing the configuration of a speech decoding apparatus according to the second embodiment of the present invention. Since the components in the figure which are the same as or correspond to those in FIG. 3 are denoted by like numerals, their explanation will be omitted.

Reference numeral 80 denotes a fixed excitation decoding unit for determining a periodicity emphasis coefficient from the gain of an adaptive excitation signal, and outputting a fixed excitation signal which is a time-series vector corresponding to the periodicity emphasis coefficient and the fixed excitation code output from the separating unit 71.

Figure 9:
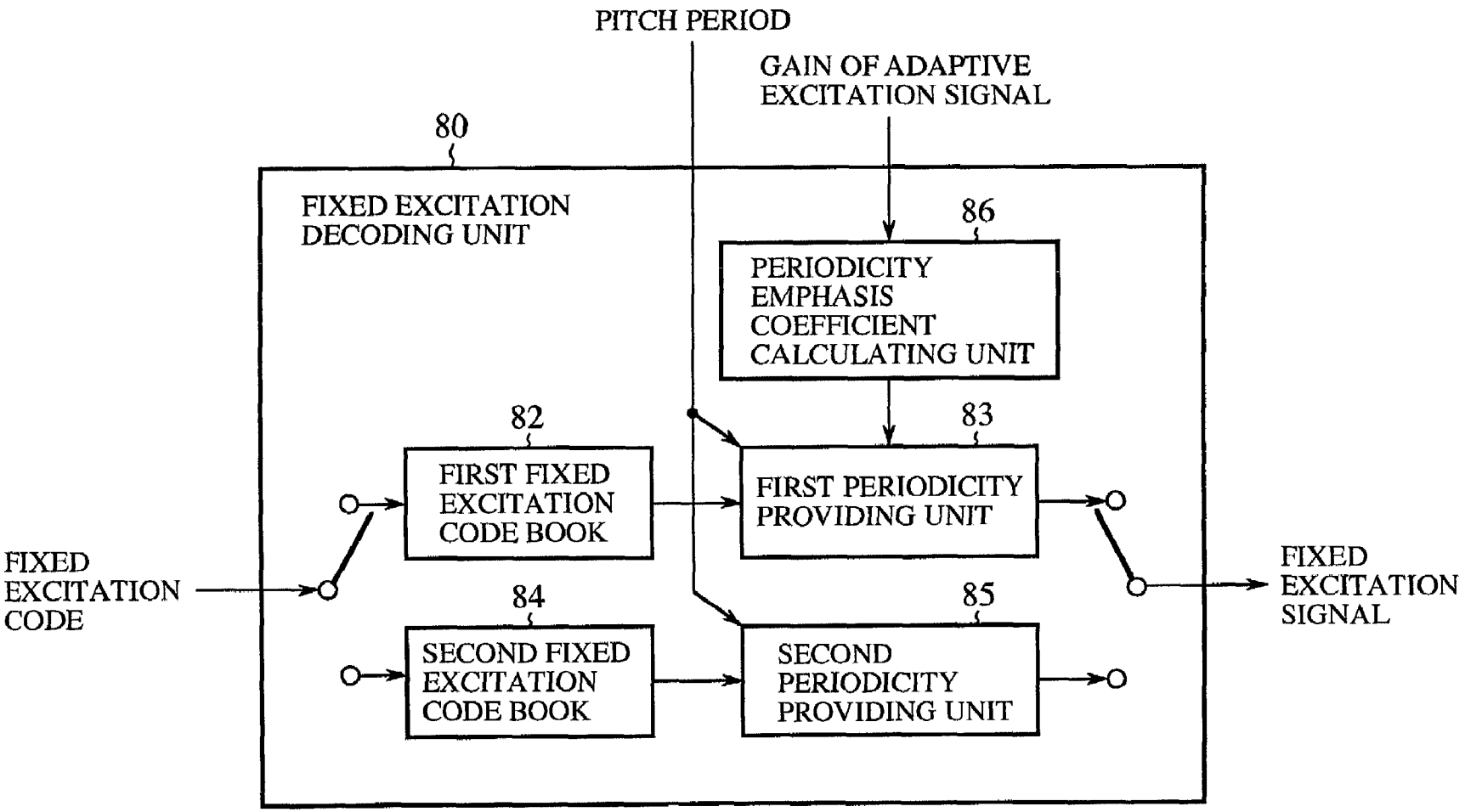
FIG. 9 is a schematic diagram showing the internal configuration of a fixed excitation decoding unit.

FIG. 9 is a schematic diagram showing the internal configuration of the fixed excitation decoding unit 80. Since the components in the figure which are the same as or correspond to those in FIG. 4 are denoted by like numerals, their explanation will be omitted.

Reference numeral 86 denotes a periodicity emphasis coefficient calculating unit for determining a periodicity emphasis coefficient from the gain of an adaptive excitation signal.

The operations of the speech encoding and speech decoding apparatuses will now be described below.

It should be noted that since the second embodiment is the same as the first embodiment except for the periodicity emphasis coefficient calculating unit 62 in the fixed excitation encoding unit 47, the gain encoding unit 48, and the periodicity emphasis coefficient calculating unit 86 in the fixed excitation decoding unit 80, only their difference will be described.

The periodicity emphasis coefficient calculating unit 62 uses the gain for an adaptive excitation signal output from the gain encoding unit 48 to determine a periodicity emphasis coefficient (for example, the gain for the adaptive excitation signal in a previous frame), and outputs the thus determined periodicity emphasis coefficient to the first periodicity providing unit 54.

The gain encoding unit 48, which has a built-in gain code book storing gain vectors, sequentially reads a gain vector from the gain code book according to each internally-generated gain code (indicated by a binary number having a few bits).

The gain encoding unit 48 multiplies both the adaptive excitation signal output from the adaptive excitation encoding unit 43 and the fixed excitation signal output from the fixed excitation encoding unit 47 by each element of the gain vector, and adds each respective pair of the multiplication results together to generate an excitation signal.

The gain encoding unit 48 then generates a tentative synthesized speech by passing the excitation signal through a synthesis filter which uses the quantized values of the linear prediction coefficients output from the linear prediction coefficient encoding unit 42.

Furthermore, the gain encoding unit 48 evaluates, for example, the distance between the tentative synthesized speech and the input speech to obtain the encoding distortion, selects and outputs to the multiplexing unit 49 gain code with which the distance is minimized. The gain encoding unit 48 also outputs to the adaptive excitation encoding unit 43 an excitation signal corresponding to the gain code, and outputs to the fixed excitation encoding unit 47 the gain of the adaptive excitation signal corresponding to the gain code.

The periodicity emphasis coefficient calculating unit 86 determines a periodicity emphasis coefficient, as does the periodicity emphasis coefficient calculating unit 62 in the fixed excitation encoding unit 47, from the gain of the adaptive excitation signal output from the gain decoding unit 75, and outputs the periodicity emphasis coefficient to the first periodicity providing unit 83.

As can be seen from the above description, since the second embodiment is configured such that a first periodicity coefficient is determined based on a parameter obtainable from speech code, it is not necessary to encode a periodicity emphasis coefficient separately. Accordingly, even at a low bit rate, it is possible to emphasize the periodicity for a fixed code vector by use of the first periodicity emphasis coefficient adaptively determined based on a predetermined rule or a fixed second periodicity emphasis coefficient, thereby obtaining an output speech of subjectively-high quality.

(Third Embodiment)

Figure 10:
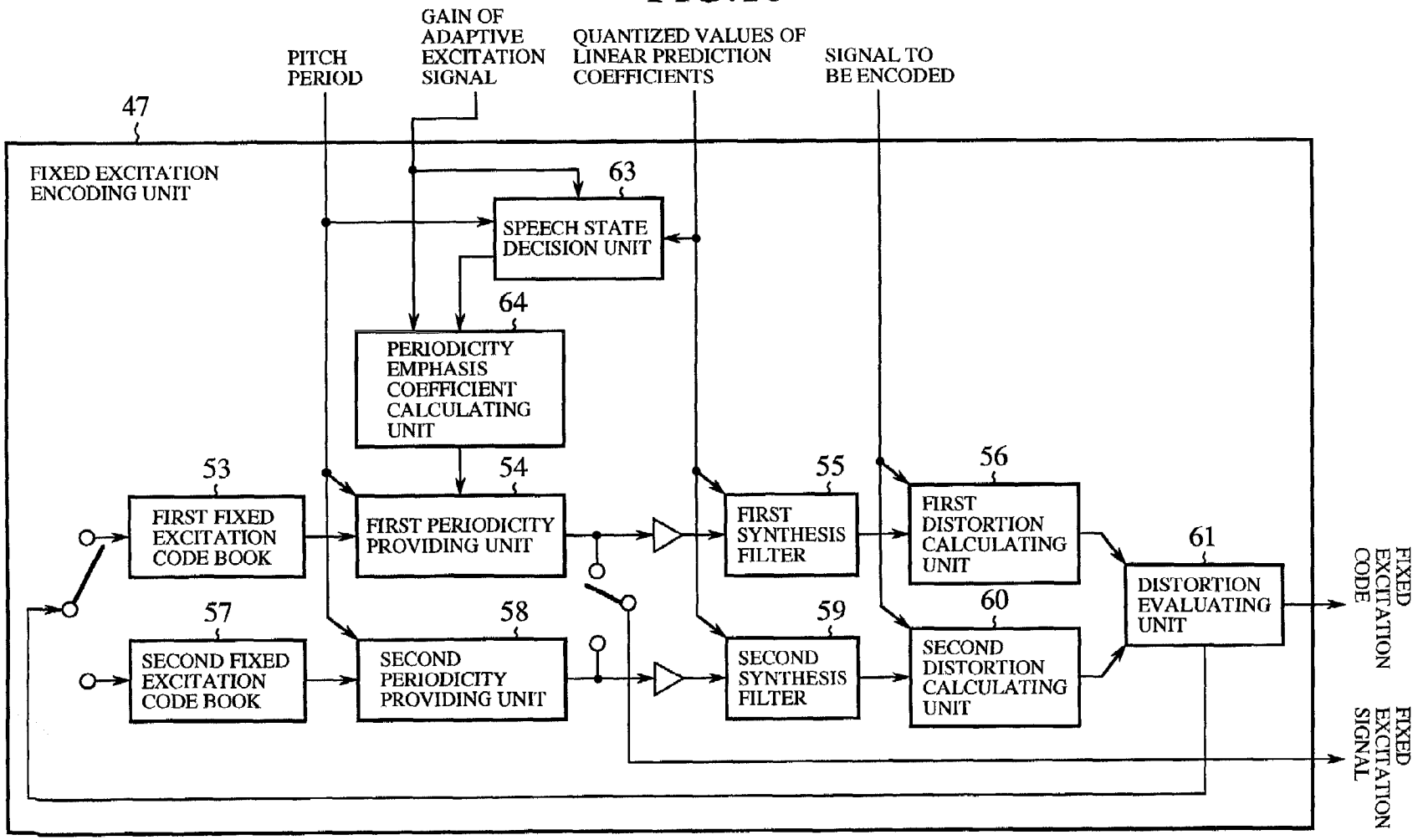
FIG. 10 is a schematic diagram showing the internal configuration of a fixed excitation encoding unit.

FIG. 10 is a schematic diagram showing the internal configuration of the fixed excitation encoding unit 47 included in an encoding apparatus according to a third embodiment. Since the components in the figure which are the same as or correspond to those in FIG. 2 are denoted by like numerals, their explanation will be omitted.

Reference numeral 63 denotes a speech state decision unit for determining the state of a speech from quantized values of the linear prediction coefficients, the pitch period, and the gain of an adaptive excitation signal, while reference numeral 64 denotes a periodicity emphasis coefficient calculating unit for determining a periodicity emphasis coefficient from the speech state decision result and the gain of the adaptive excitation signal.

Figure 11:
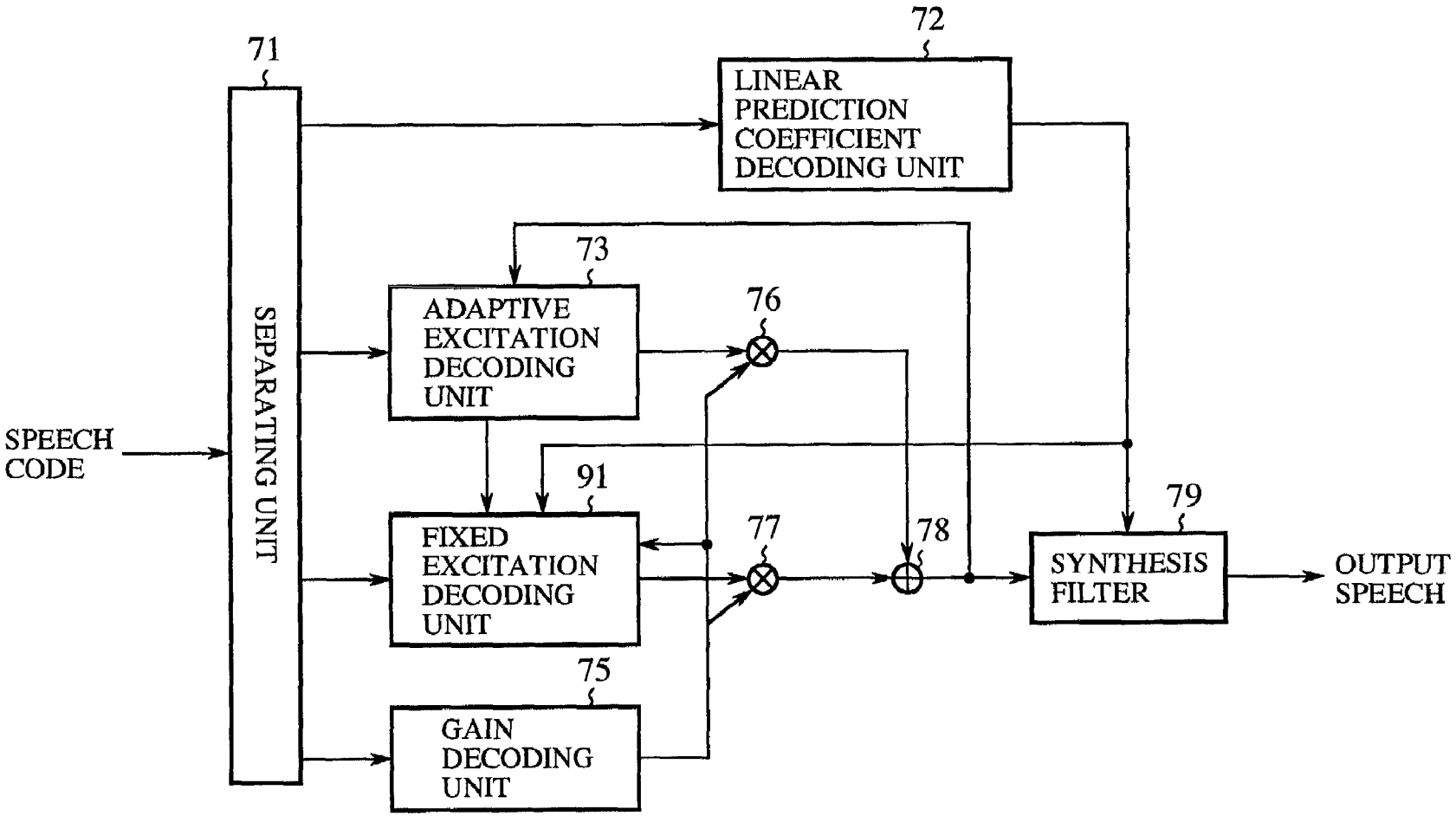
FIG. 11 is a schematic diagram showing the configuration of a speech decoding apparatus according to a third embodiment of the present invention.

FIG. 11 is a schematic diagram showing the configuration of a speech decoding apparatus according to a third embodiment of the present invention. Since the components in the figure which are the same as or correspond to those in FIG. 3 are denoted by like numerals, their explanation will be omitted.

Reference numeral 91 denotes a fixed excitation decoding unit for: determining the state of a speech from quantized values of the linear prediction coefficients, the pitch period, and the gain of an adaptive excitation signal; determining a periodicity emphasis coefficient from the speech state decision result and the gain of the adaptive excitation signal; and outputting a fixed excitation signal which is a time-series vector corresponding to both the periodicity emphasis coefficient and fixed excitation code output from the separating unit 71.

Figure 12:
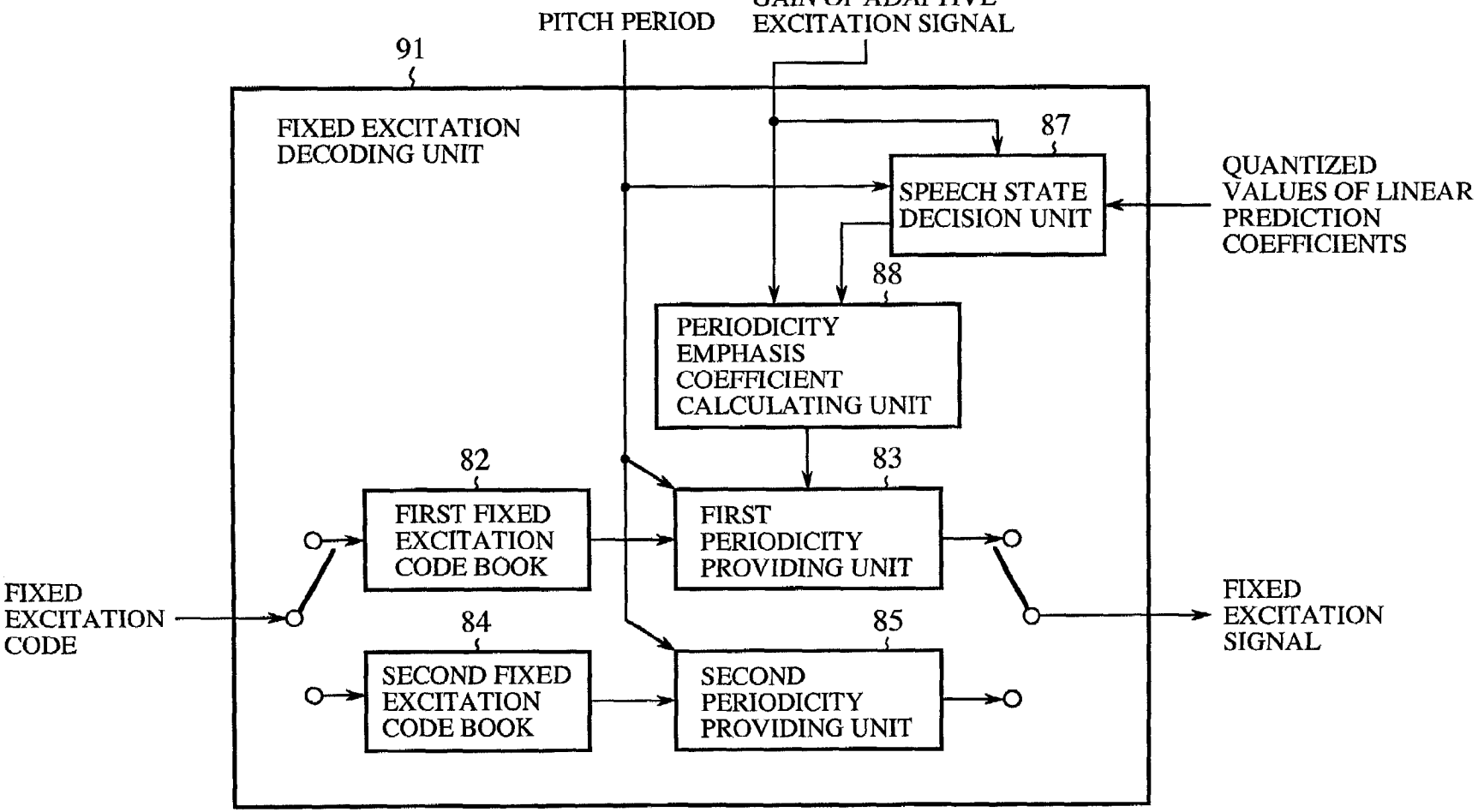
FIG. 12 is a schematic diagram showing the internal configuration of a fixed excitation decoding unit.
Figure 13:
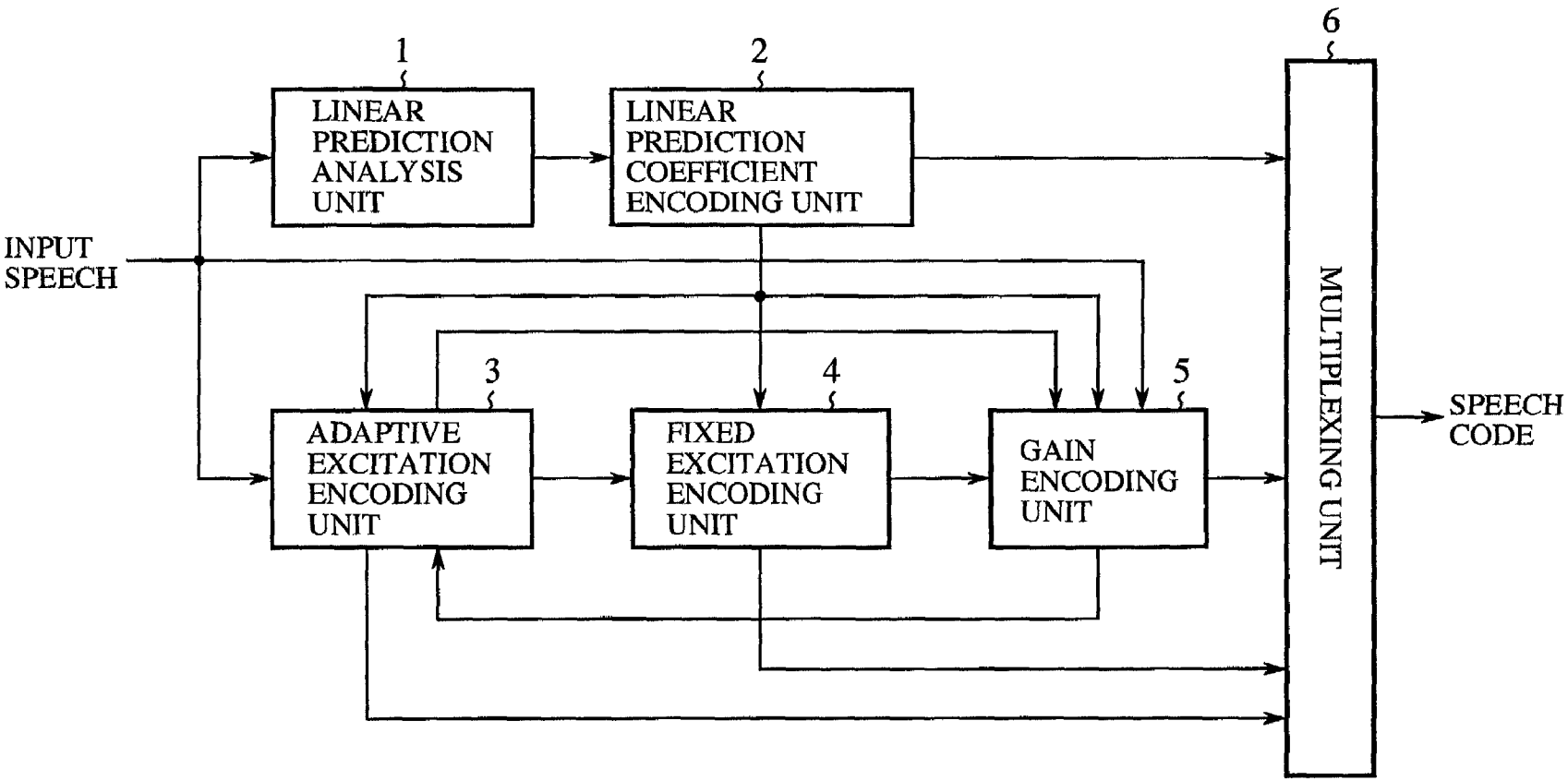
FIG.13 (PRIOR ART)
FIG. 13 is a schematic diagram showing the configuration of a conventional CELP-type speech encoding apparatus.
Figure 14:
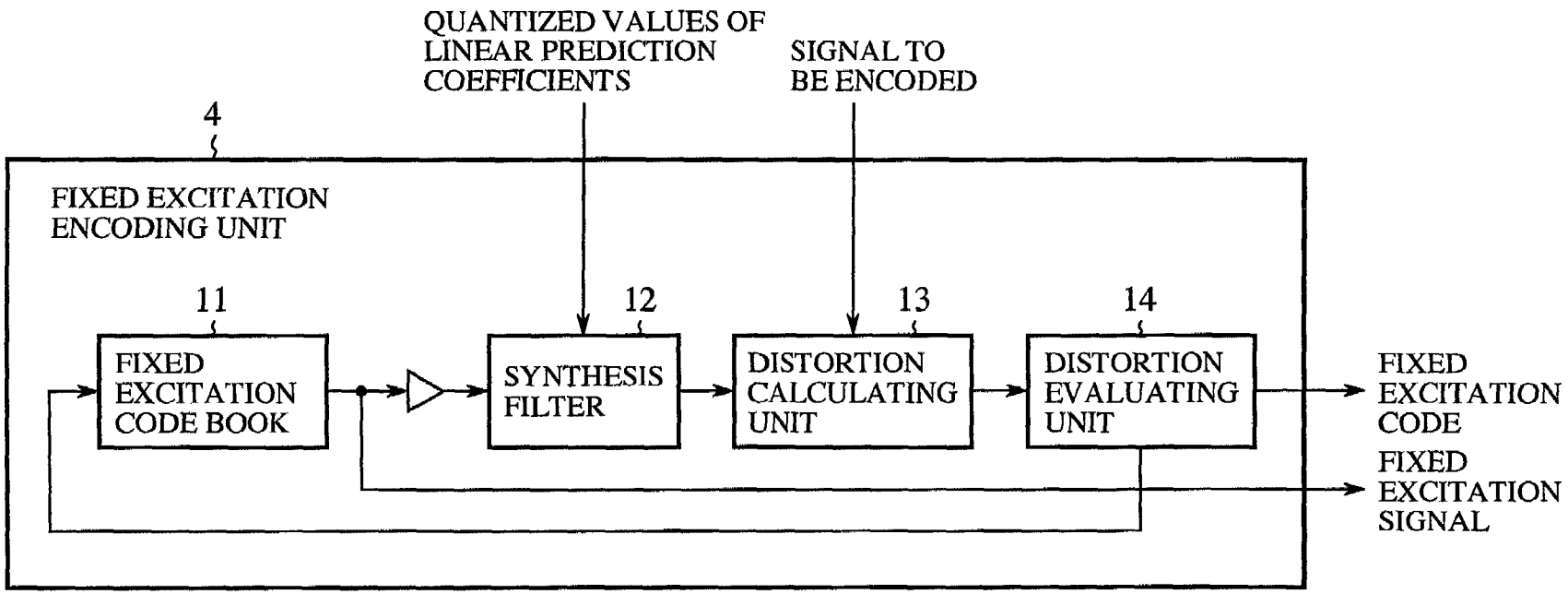
FIG.14 (PRIOR ART)
FIG. 14 is a schematic diagram showing the internal configuration of a fixed excitation encoding unit.
Figure 15:
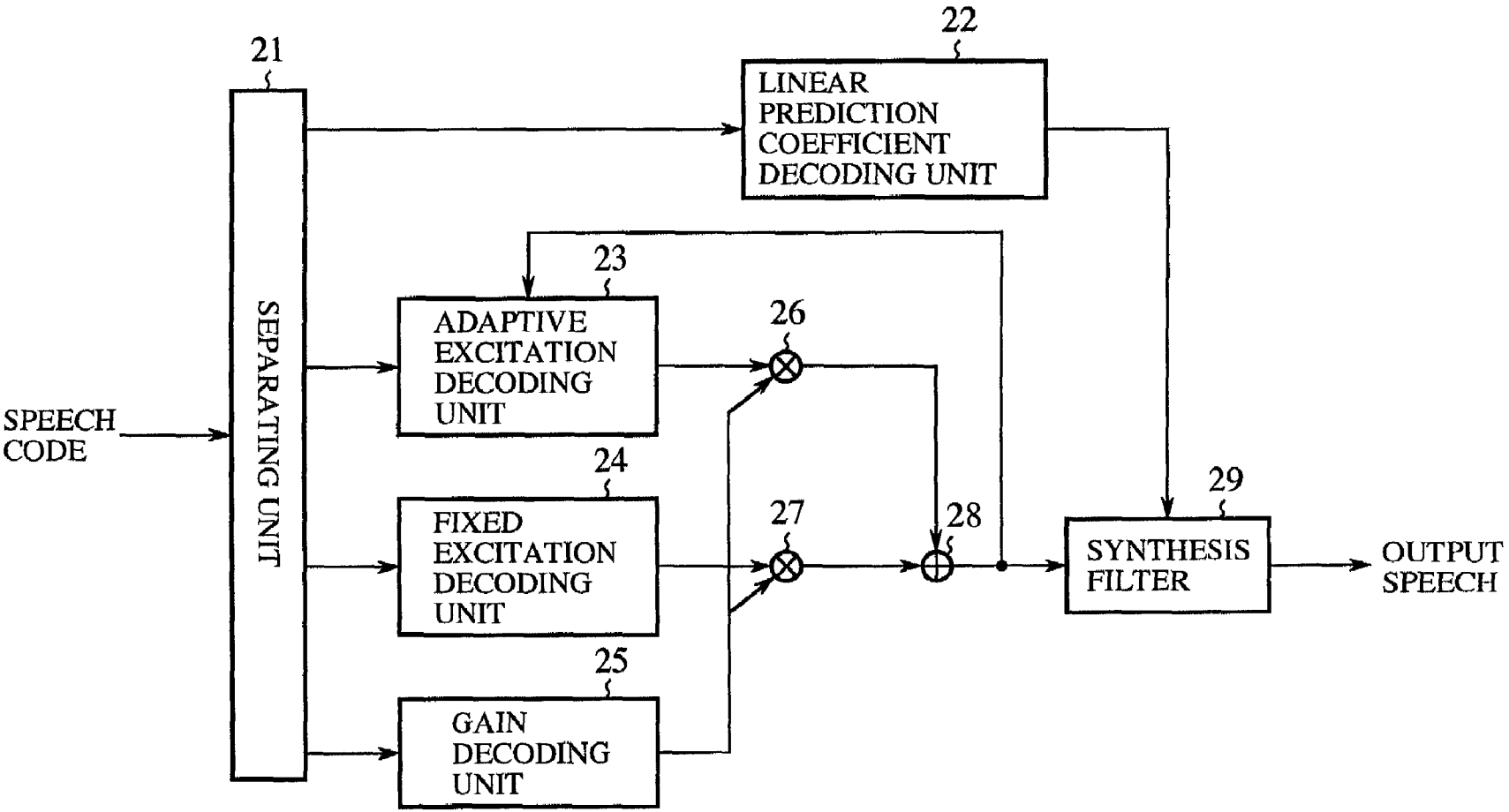
FIG.15 (PRIOR ART)
FIG. 15 is a schematic diagram showing the configuration of a conventional CELP-type speech decoding apparatus.
Figure 16:
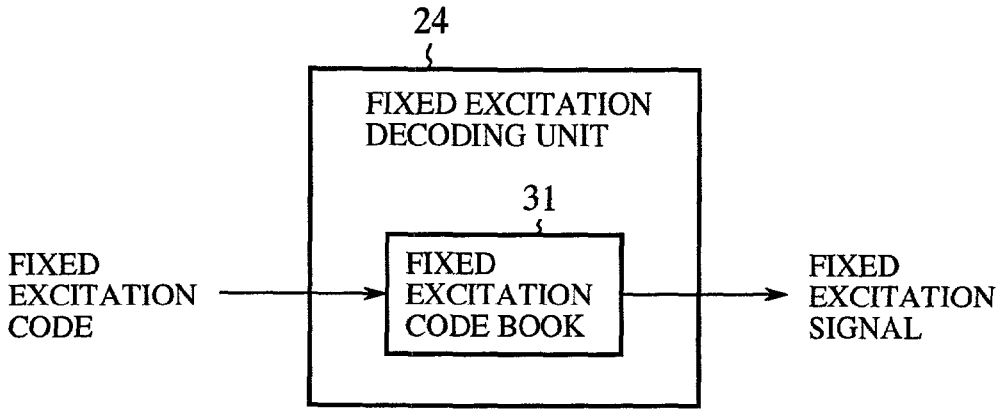
FIG.16 (PRIOR ART)
FIG. 16 is a schematic diagram showing the internal configuration of a fixed excitation decoding unit.
Figure 18:
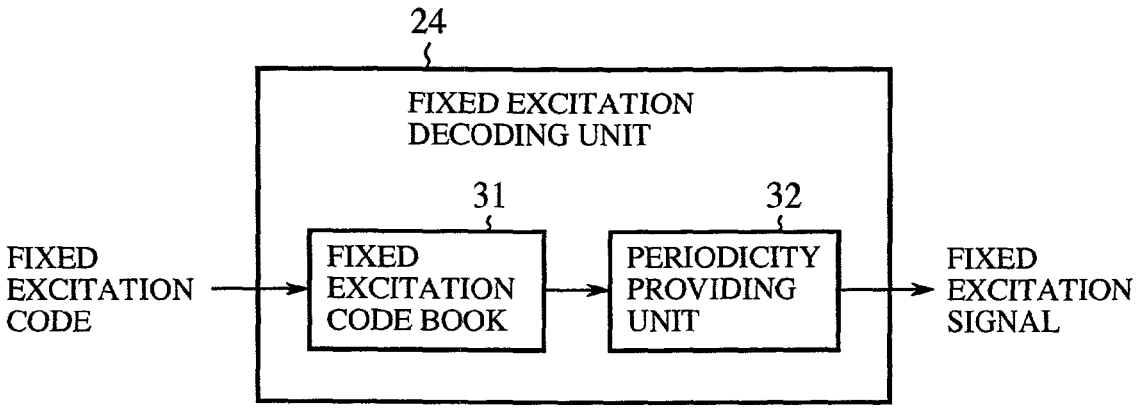
FIG.18 (PRIOR ART)
FIG. 18 is a schematic diagram showing the internal configuration of a fixed excitation decoding unit which includes a periodicity providing unit.
Figure 17:
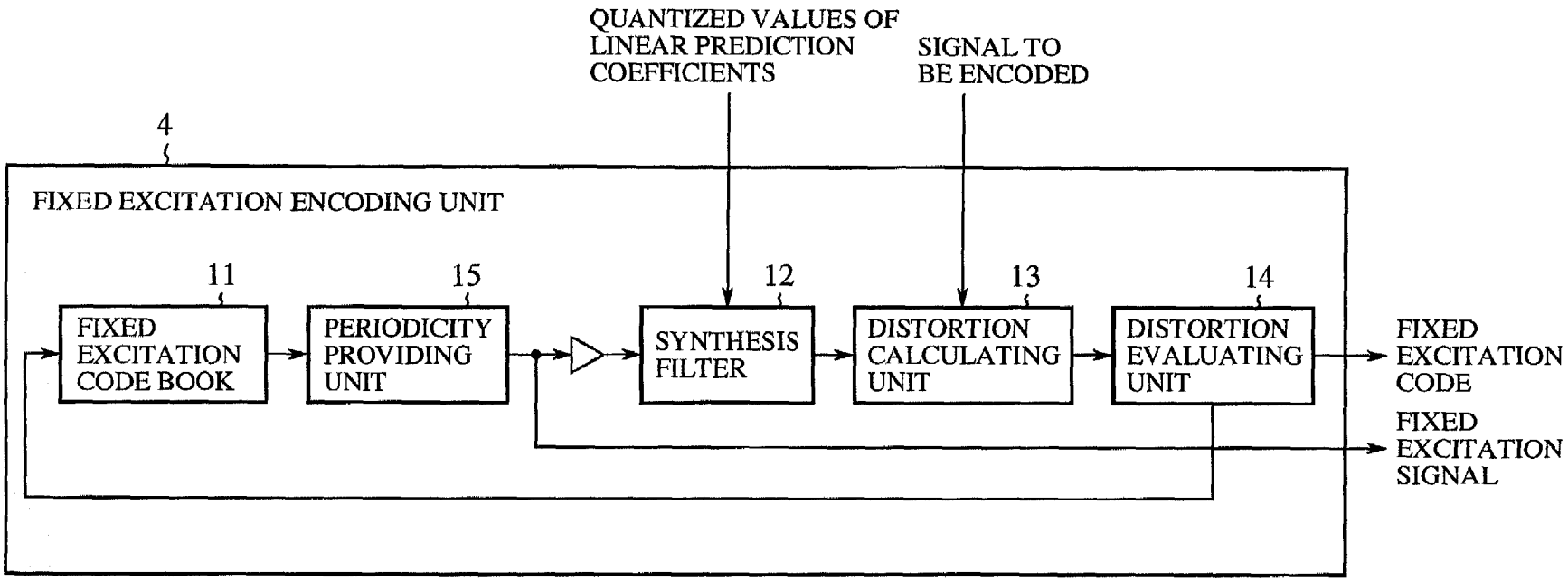
FIG.17 (PRIOR ART)
FIG. 17 is a schematic diagram showing the internal configuration of a fixed excitation encoding unit which includes a periodicity providing unit.
Figure 19:
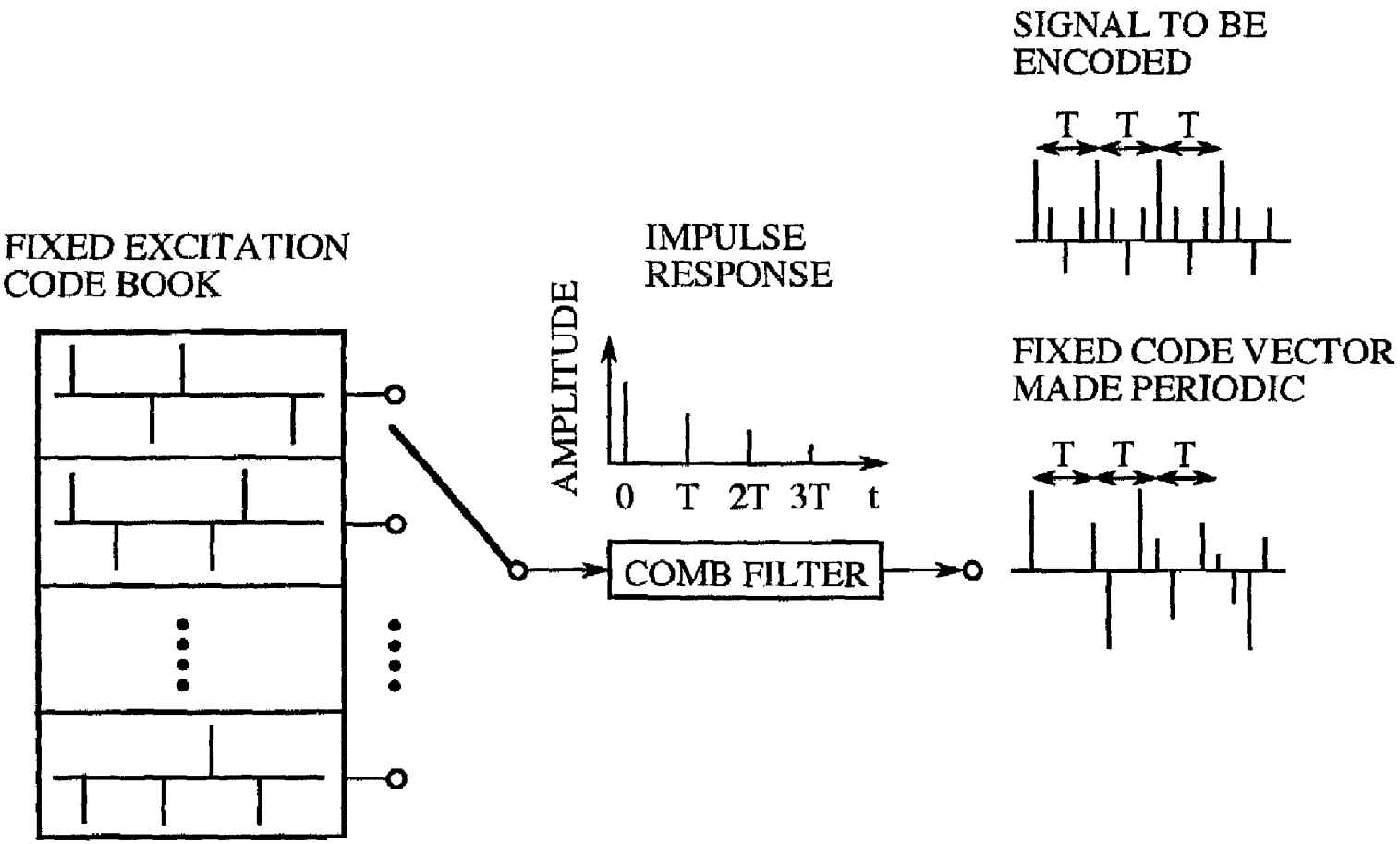
FIG.19 (PRIOR ART)
FIG. 19 is a schematic diagram illustrating periodicity emphasis for fixed code vectors.

FIG. 12 is a schematic diagram showing the internal configuration of the fixed excitation decoding unit 91. Since the components in the figure which are the same as or correspond to those in FIG. 4 are denoted by like numerals, their explanation will be omitted.

Reference numeral 87 denotes a speech state decision unit for determining the state of a speech from quantized values of the linear prediction coefficients, the pitch period, the gain of an adaptive excitation signal, while reference numeral 88 denotes a periodicity emphasis coefficient calculating unit for determining a periodicity emphasis coefficient from the speech state decision result and the gain of the adaptive excitation signal.

The operation of the third embodiment will now be described below.

It should be noted that since the third embodiment is the same as the second embodiment except for the speech state decision unit 63 and the periodicity emphasis coefficient calculating unit 64 in the fixed excitation encoding unit 47, and the speech state decision unit 87 and the periodicity emphasis coefficient calculating unit 88 in the fixed excitation decoding unit 91, only their difference will be described.

The speech state decision unit 63 determines the state of an input speech (for example, by selecting from among a fricative, a steady voice, and others) based on the quantized values of the linear prediction coefficients output from the linear prediction coefficient encoding unit 42, the pitch period output from the adaptive excitation encoding unit 43, and the gain of the adaptive excitation signal output from the gain encoding unit 48, and outputs the determination result to the periodicity emphasis coefficient calculating unit 64.

For example, the speech state is determined as follows. First, the slope of the spectrum is obtained based on the quantized values of the linear prediction coefficients. If the slope indicates that the power of the speech increases as the frequency becomes higher, the state of the speech is determined to be a fricative. Then, the changes in the pitch period and the gain are evaluated in terms of time. If the changes are small, the speech is determined to be a steady voice. Otherwise, the speech is determined to belong to "others".

The periodicity emphasis coefficient calculating unit 64 uses the speech state decision result output from the speech state decision unit 63 and the gain for the adaptive excitation signal output from the gain encoding unit 48 to determine a periodicity emphasis coefficient (for example, take the gain for the adaptive excitation signal in a previous frame for the coefficient), and outputs the determined periodicity emphasis coefficient to the first periodicity providing unit 54.

The above periodicity emphasis coefficient is determined as follows. If the speech state is a fricative, the degree of the emphasis is decreased. If the speech state is a steady voice, on the other hand, the degree of the emphasis is increased.

With this arrangement, it is possible to eliminate placement of inappropriate periodicity emphasis such as putting much periodicity emphasis on a fixed excitation vector in a fricative section, in which the input speech intrinsically does not have any periodicity, or putting only little periodicity emphasis on a fixed excitation vector in a steady voice section, in which the input speech intrinsically has strong periodicity. Thus, the third embodiment can provide an encoded speech of subjectively-high quality.

The speech state decision unit 87 determines the state of a speech, as does the speech state decision unit 63 in the fixed excitation encoding unit 47, from the quantized values of the linear prediction coefficients output from the linear prediction coefficient decoding unit 72, the pitch period output from the adaptive excitation decoding unit 73, and the gain of the adaptive excitation signal output from the gain encoding unit 75, and outputs the determination result to the periodicity emphasis coefficient calculating unit 88.

The periodicity emphasis coefficient calculating unit 88 determines a periodicity emphasis coefficient, as does the periodicity emphasis coefficient calculating unit 64 in the fixed excitation encoding unit 47, from the speech state decision result output from the speech state decision unit 87 and the gain of the adaptive excitation signal output from the gain decoding unit 75, and outputs the determined periodicity emphasis coefficient to the first periodicity providing unit 83.

In the above arrangement, the speech state is decided based on a parameter obtainable from speech code, and a periodicity emphasis coefficient is determined from this decision result. Therefore, it is possible to control the periodicity emphasis coefficient more finely without increasing information to be transferred, thereby obtaining an encoded speech of subjectively-high quality.

Further, when the speech state decision result indicates a fricative, which intrinsically does not have any periodicity, the periodicity emphasis coefficient (the degree of the emphasis) is decreased. Therefore, it is possible to obtain an encoded speech of subjectively-high quality.

Still further, the periodicity emphasis coefficient (the degree of the emphasis) is increased when the speech state decision result indicates a steady voice, which intrinsically has strong periodicity, making it possible to also obtain an encoded speech of subjectively-high quality.

(Fourth Embodiment)

In the above first to third embodiments, either the first or second periodicity providing process is applied to a fixed excitation code book based on the noise characteristics of fixed code vectors stored in the fixed excitation code book. However, the present invention may be configured such that the first fixed excitation code books 53 and 82 store a plurality of time-series vectors (fixed code vectors) whose power distribution is flat in terms of time while the second fixed excitation code books 57 and 84 store a plurality of time-series vectors (fixed code vectors) whose power distribution is biased to the first half of the frame.

With this arrangement, it is possible to constantly give strong periodicity to fixed code vectors whose power distribution is biased so as to reduce the bias of the power distribution of the fixed code vectors after they are given the periodicity, thereby obtaining an encoded speech of subjectively-high quality.

(Fifth Embodiment)

The above first to fourth embodiments each employ two fixed excitation code books. However, three or more fixed excitation code books may be used, and the fixed excitation encoding unit 44 and 47 and the fixed excitation decoding unit 74, 80, and 91 may be configured accordingly.

Further, the above first to fourth embodiments each explicitly indicate a plurality of fixed excitation code books. However, time-series vectors stored in a single fixed excitation code book may be divided into a plurality of subsets, and each subset may be regarded as an individual fixed excitation code book.

Further, in the above first to fourth embodiments, the fixed code vectors stored in the first fixed excitation code books 53 and 82 are different from those stored in the second fixed excitation code books 57 and 84. However, all of the above first and second fixed excitation code books may store the same fixed code vectors. This means that both the first and second periodicity providing units are applied to the same single fixed excitation code book.

Further, the above first to fourth embodiments are each configured so as to have two synthesis filters, namely the first synthesis filter 55 and the second synthesis filter 59. However, since both filters carry out the same operation, the present invention may be configured such that a single synthesis filter is used commonly. Similarly, a single distortion calculating unit may be commonly used as the first distortion calculating unit 56 and the second distortion calculating unit 60.

As described above, a speech encoding apparatus according to the present invention comprises: first periodicity providing unit for, when encoding distortions of fixed code vectors are evaluated, emphasizing periodicity of a fixed code vector output from at least one fixed excitation code book by use of a first periodicity emphasis coefficient adaptively determined based on a predetermined rule; and second periodicity providing unit for emphasizing periodicity of a fixed code vector output from at least one fixed excitation code book by use of a predetermined second periodicity emphasis coefficient. Therefore, when one of the first periodicity emphasis coefficient and the second periodicity emphasis coefficient has been set to an inappropriate value, it is possible to limit the adverse influence by the inappropriate periodicity emphasis coefficient to part of the fixed code vectors, thereby obtaining an output speech of subjectively-high quality.

A speech encoding method according to the present invention comprises: a first periodicity providing step of, when encoding distortions of fixed code vectors are evaluated, emphasizing periodicity of a fixed code vector output from at least one fixed excitation code book by use of a first periodicity emphasis coefficient adaptively determined based on a predetermined rule; and a second periodicity providing step of emphasizing periodicity of a fixed code vector output from at least one fixed excitation code book by use of a predetermined second periodicity emphasis coefficient. Therefore, when one of the first periodicity emphasis coefficient and the second periodicity emphasis coefficient has been set to an inappropriate value, it is possible to limit the adverse influence by the inappropriate periodicity emphasis coefficient to part of the fixed code vectors, thereby obtaining an output speech of subjectively-high quality.

A speech encoding method according to the present invention analyzes an input speech to determine a first periodicity emphasis coefficient. Therefore, it is possible to reduce the frequency of determination of an inappropriate periodicity emphasis coefficient, thereby obtaining an output speech of subjectively-high quality.

A speech encoding method according to the present invention determines a first periodicity emphasis coefficient from speech code. Therefore, it is possible to emphasize the periodicity of a fixed code vector without encoding a periodicity emphasis coefficient separately, that is, without increasing information to be transferred, thereby obtaining an output speech of subjectively-high quality.

A speech encoding method according to the present invention decides a state of a speech, and determines a first periodicity emphasis coefficient based on the state decision result. Therefore, it is possible to control a periodicity emphasis coefficient more finely, thereby obtaining an encoded speech of subjectively-high quality.

A speech encoding method according to the present invention determines a fricative section in a speech, and decreases an emphasis degree of a first periodicity emphasis coefficient in the fricative section. Therefore, it is possible to obtain an encoded speech of subjectively-high quality.

A speech encoding method according to the present invention determines a steady voice section in a speech, and increases an emphasis degree of a first periodicity emphasis coefficient in the steady voice section. Therefore, it is possible to obtain an encoded speech of subjectively-high quality.

A speech encoding method according to the present invention applies either a first periodicity providing step or a second periodicity providing step to a fixed excitation code book based on noise characteristics of fixed code vectors stored in the fixed excitation code book. Therefore, the speech quality of the output speech is improved with respect to noise characteristics, and furthermore the output speech is prevented from assuming pulse-like speech quality, making it possible to obtain an encoded speech of subjectively-high quality.

A speech encoding method according to the present invention applies either a first periodicity providing step or a second periodicity providing step to a fixed excitation code book based on power distribution of fixed code vectors in terms of time stored in the fixed excitation code book. Therefore, the bias of the power distribution of the fixed code vectors is reduced after they are given periodicity, making it possible to obtain an encoded speech of subjectively-high quality.

A speech decoding apparatus according to the present invention comprises: first periodicity providing unit for, when a fixed code vector corresponding to fixed excitation code is extracted, emphasizing periodicity of a fixed code vector output from at least one fixed excitation code book by use of a first periodicity emphasis coefficient adaptively determined based on a predetermined rule; and second periodicity providing unit for emphasizing periodicity of a fixed code vector output from at least one fixed excitation code book by use of a predetermined second periodicity emphasis coefficient. Therefore, when one of the first periodicity emphasis coefficient and the second periodicity emphasis coefficient has been set to an inappropriate value, it is possible to limit the adverse influence by the inappropriate periodicity emphasis coefficient to part of the fixed code vectors, thereby obtaining an output speech of subjectively-high quality.

A speech decoding method according to the present invention comprises: a first periodicity providing step of, when a fixed code vector corresponding to fixed excitation code is extracted, emphasizing periodicity of a fixed code vector output from at least one fixed excitation code book by use of a first periodicity emphasis coefficient adaptively determined based on a predetermined rule; and a second periodicity providing step of emphasizing periodicity of a fixed code vector output from at least one fixed excitation code book by use of a predetermined second periodicity emphasis coefficient. Therefore, when one of the first periodicity emphasis coefficient and the second periodicity emphasis coefficient has been set to an inappropriate value, it is possible to limit the adverse influence by the inappropriate periodicity emphasis coefficient to part of the fixed code vectors, thereby obtaining an output speech of subjectively-high quality.

A speech decoding method according to the present invention decodes a first periodicity emphasis coefficient from code of a periodicity emphasis coefficient included in speech code. Therefore, it is possible to obtain an output speech of subjectively-high quality.

A speech decoding method according to the present invention determines a first periodicity emphasis coefficient from speech code. Therefore, it is possible to emphasize the periodicity of a fixed code vector without encoding a periodicity emphasis coefficient separately, that is, without increasing information to be transferred, thereby obtaining an output speech of subjectively-high quality.

A speech decoding method according to the present invention decides a state of a speech, and determines a first periodicity emphasis coefficient based on the state decision result. Therefore, it is possible to control a periodicity emphasis coefficient more finely, thereby obtaining an encoded speech of subjectively-high quality.

A speech decoding method according to the present invention determines a fricative section in a speech, and decreases an emphasis degree of a first periodicity emphasis coefficient in the fricative section. Therefore, it is possible to obtain an encoded speech of subjectively-high quality.

A speech decoding method according to the present invention determines a steady voice section in a speech, and increases an emphasis degree of a first periodicity emphasis coefficient in the steady voice section. Therefore, it is possible to obtain an encoded speech of subjectively-high quality.

A speech decoding method according to the present invention applies either a first periodicity providing step or a second periodicity providing step to a fixed excitation code book based on noise characteristics of fixed code vectors stored in the fixed excitation code book. Therefore, the speech quality of the output speech is improved with respect to noise characteristics, and furthermore the output speech is prevented from assuming pulse-like speech quality, making it possible to obtain an encoded speech of subjectively-high quality.

A speech decoding method according to the present invention applies either a first periodicity providing step or a second periodicity providing step to a fixed excitation code book based on power distribution of fixed code vectors in terms of time stored in the fixed excitation code book. Therefore, the bias of the power distribution of the fixed code vectors is reduced after they are given periodicity, making it possible to obtain an encoded speech of subjectively-high quality.

What is claimed is:

1. A speech encoding apparatus comprising:

a spectral envelope information encoding unit for extracting spectral envelope information on an input speech, and encoding the spectral envelope information;

an excitation information encoding unit for, by use of said spectral envelope information extracted by said spectral envelope information encoding unit, determining adaptive excitation code, fixed excitation code, and gain code with which an encoding distortion of a synthesized speech to be generated is minimized; and a multiplexer for multiplexing said spectral envelope information encoded by said spectral envelope information encoding unit and said adaptive excitation code, said fixed excitation code, and said gain code each determined by said excitation information encoding unit so as to output speech code;

wherein said excitation information encoding unit includes:

a fixed excitation encoding unit for evaluating encoding distortions of fixed code vectors stored in a plurality of fixed excitation code books to determine said fixed excitation code;

a first periodicity providing unit for, when said encoding distortions of said fixed code vectors are evaluated, emphasizing periodicity of a fixed code vector output from at least one fixed excitation code book by use of a first periodicity emphasis coefficient adaptively determined based on a predetermined rule; and a second periodicity providing unit for emphasizing periodicity of a fixed code vector output from at least one fixed excitation code book by use of a fixed second periodicity emphasis coefficient.

2. A speech encoding method comprising:

a spectral envelope information encoding step of extracting spectral envelope information on an input speech, and encoding the spectral envelope information;

an excitation information encoding step of, by use of said spectral envelope information extracted by said spectral envelope information encoding step, determining adaptive excitation code, fixed excitation code, and gain code with which an encoding distortion of a synthesized speech to be generated is minimized; and a multiplexing step of multiplexing said spectral envelope information encoded by said spectral envelope information encoding step and said adaptive excitation code, said fixed excitation code, and said gain code each determined by said excitation information encoding step so as to output speech code;

wherein said excitation information encoding step includes:

a fixed excitation encoding step of evaluating encoding distortions of fixed code vectors stored in a plurality of fixed excitation code books to determine said fixed excitation code;

a first periodicity providing step of, when said encoding distortions of said fixed code vectors are evaluated, emphasizing periodicity of a fixed code vector output from at least one fixed excitation code book by use of a first periodicity emphasis coefficient adaptively determined based on a predetermined rule; and a second periodicity providing step of emphasizing periodicity of a fixed code vector output from at least one fixed excitation code book by use of a fixed second periodicity emphasis coefficient.

3. The speech encoding method as claimed in claim 2, wherein said speech encoding method analyzes said input speech to determine said first periodicity emphasis coefficient.

4. The speech encoding method as claimed in claim 2, wherein said speech encoding method determines said first periodicity emphasis coefficient from speech code.

5. The speech encoding method as claimed in claim 4, wherein said speech encoding method decides a state of a speech, and determines said first periodicity emphasis coefficient based on the state decision result.

6. The speech encoding method as claimed in claim 5, wherein said speech encoding method determines a fricative section in a speech, and decreases an emphasis degree of said first periodicity emphasis coefficient in the fricative section.

7. The speech encoding method as claimed in claim 5, wherein said speech encoding method determines a steady voice section in a speech, and increases an emphasis degree of said first periodicity emphasis coefficient in the steady voice section.

8. The speech encoding method as claimed in claim 2, wherein, based on noise characteristics of fixed code vectors stored in the fixed excitation code book, said speech encoding method applies either said first periodicity providing step or said second periodicity providing step to the fixed excitation code book.

9. The speech encoding method as claimed in claim 2, wherein, based on power distribution of fixed code vectors in terms of time stored in the fixed excitation code book, said speech encoding method applies either said first periodicity providing step or said second periodicity providing step to the fixed excitation code book.

10. A speech decoding apparatus comprising:

a separating unit for separating speech code into spectral envelope information and excitation information including adaptive excitation code, fixed excitation code, and gain code;

a spectral envelope information decoding unit for decoding said spectral envelope information separated by said separating unit; and an excitation information decoding unit for decoding excitation signal from said adaptive excitation code, said fixed excitation code, and said gain code separated by said separating unit;

wherein said excitation information decoding unit includes:

a fixed excitation decoding unit for, from among fixed code vectors stored in a plurality of fixed excitation code books, extracting a fixed code vector corresponding to said fixed excitation code;

a first periodicity providing unit for, when said fixed code vector corresponding to said fixed excitation code is extracted, emphasizing periodicity of a fixed code vector output from at least one fixed excitation code book by use of a first periodicity emphasis coefficient adaptively determined based on a predetermined rule; and a second periodicity providing unit for emphasizing periodicity of a fixed code vector output from at least one fixed excitation code book by use of a fixed second periodicity emphasis coefficient.

11. A speech decoding method comprising:

a separating step of separating speech code into spectral envelope information and excitation information including adaptive excitation code, fixed excitation code, and gain code;

a spectral envelope information decoding step of decoding said spectral envelope information separated by said separating step; and an excitation information decoding step of decoding excitation signal from said adaptive excitation code, said fixed excitation code, and said gain code separated by said separating step;

wherein said excitation information decoding step includes:

a fixed excitation decoding step of, from among fixed code vectors stored in a plurality of fixed excitation code books, extracting a fixed code vector corresponding to said fixed excitation code;

a first periodicity providing step of, when said fixed code vector corresponding to said fixed excitation code is extracted, emphasizing periodicity of a fixed code vector output from at least one fixed excitation code book by use of a first periodicity emphasis coefficient adaptively determined based on a predetermined rule; and a second periodicity providing step of emphasizing periodicity of a fixed code vector output from at least one fixed excitation code book by use of a fixed second periodicity emphasis coefficient.

12. The speech decoding method as claimed in claim 11, wherein said speech decoding method decodes said first periodicity emphasis coefficient from code of a periodicity emphasis coefficient included in speech code.

13. The speech decoding method as claimed in claim 11, wherein said speech decoding method determines said first periodicity emphasis coefficient from speech code.

14. The speech decoding method as claimed in claim 13, wherein said speech decoding method decides a state of a speech, and determines said first periodicity emphasis coefficient based on the state decision result.

15. The speech decoding method as claimed in claim 14, wherein said speech decoding method determines a fricative section in a speech, and decreases an emphasis degree of said first periodicity emphasis coefficient in the fricative section.

16. The speech decoding method as claimed in claim 14, wherein said speech decoding method determines a steady voice section in a speech, and increases an emphasis degree of said first periodicity emphasis coefficient in the steady voice section.

17. The speech decoding method as claimed in claim 11, wherein, based on noise characteristics of fixed code vectors stored in the fixed excitation code book, said speech decoding method applies either said first periodicity providing step or said second periodicity providing step to the fixed excitation code book.

18. The speech decoding method as claimed in claim 11, wherein, based on power distribution of fixed code vectors in terms of time stored in the fixed excitation code book, said speech decoding method applies either said first periodicity providing step or said second periodicity providing step to the fixed excitation code book.

* * * * *